US007903057B2

(12) United States Patent
Uchino et al.

(10) Patent No.: US 7,903,057 B2
(45) Date of Patent: Mar. 8, 2011

(54) DISPLAY APPARATUS AND DRIVING METHOD THEREFOR

(75) Inventors: Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 451 days.

(21) Appl. No.: 12/086,343

(22) PCT Filed: Nov. 28, 2007

(86) PCT No.: PCT/JP2007/072956

§ 371 (c)(1),
(2), (4) Date: Jun. 11, 2008

(87) PCT Pub. No.: WO2008/087801

PCT Pub. Date: Jul. 24, 2008

(65) Prior Publication Data

US 2009/0091562 A1 Apr. 9, 2009

(30) Foreign Application Priority Data

Jan. 15, 2007 (JP) ..... 2007-005646

(51) Int. Cl.
*G09G 3/30* (2006.01)

(52) U.S. Cl. ..... 345/77; 345/76

(58) Field of Classification Search ..... 345/76–80, 345/82, 83; 315/169.3
See application file for complete search history.

(56) References Cited

U.S. PATENT DOCUMENTS

| | | | |
|---|---|---|---|
| 2005/0057459 | A1 | 3/2005 | Miyazawa |
| 2005/0083271 | A1 | 4/2005 | Suh et al. |
| 2005/0206590 | A1 | 9/2005 | Sasaki et al. |
| 2006/0170628 | A1 | 8/2006 | Yamashita et al. |

FOREIGN PATENT DOCUMENTS

| | | |
|---|---|---|
| EP | 1517290 | 3/2005 |
| JP | 2003-255856 A | 9/2003 |
| JP | 2003-271095 A | 9/2003 |

(Continued)

OTHER PUBLICATIONS

International Search Report date Jan. 8, 2008 for corresponding International Application No. PCT/JP2007/072956. Extended European Search Report issued Mar. 1, 2010 for corresponding European Application No. 07 83 2678.

*Primary Examiner* — Ricardo L Osorio

(74) *Attorney, Agent, or Firm* — Rader, Fishman & Grauer PLLC

(57) ABSTRACT

A sampling transistor T1 is brought into conduction in accordance with a control signal supplied from a scanning line WS, and writes to a holding capacitor C1 a video signal supplied from a signal line SL. A driving transistor T2 outputs a driving current to an output node S in accordance with a signal potential of the video signal written to the holding capacitor C1. A switching transistor T3 is arranged between the output node S and a light-emitting device EL. In a predetermined light-emission period, the switching transistor T3 is in an on-state, and supplies the driving current to the light-emitting device EL to cause the light-emitting device EL to emit light at a brightness corresponding to the video signal. In contrast, in a non-light-emission period, the switching transistor T3 is turned off to disconnect the light-emitting device EL from the output node S, so that a potential generated at the output node S due to an operation of a pixel 2 performed in the non-light-emission period is prevented from being applied as a reverse-bias voltage to the light-emitting device EL of a diode type.

5 Claims, 25 Drawing Sheets

FOREIGN PATENT DOCUMENTS

| | | | |
|---|---|---|---|
| JP | 2004-029791 | A | 1/2004 |
| JP | 2004-093682 | A | 3/2004 |
| JP | 2004-133240 | A | 4/2004 |
| JP | 2005-099714 | | 4/2005 |
| JP | 2005-099715 | | 4/2005 |
| JP | 2006-215213 | | 8/2006 |
| JP | 2007-156460 | | 6/2007 |
| WO | WO-2006/103802 | | 10/2006 |

(6)

(7)

(1)

(1a),(2,3)

(6)

(7)

DISPLAY APPARATUS AND DRIVING METHOD THEREFOR

TECHNICAL FIELD

The present invention relates to an active-matrix-type display apparatus in which a light-emitting device is used in pixels and a driving method for such a display apparatus.

BACKGROUND ART

Development of flat- and self-light-emitting-type display apparatuses in which organic EL devices are used as light-emitting devices has been actively conducted in recent years. Organic EL devices are devices utilizing a phenomenon where applying an electric field to an organic thin film causes light emission. Since organic EL devices are driven at an applied voltage of 10 V or less, low power consumption is required. In addition, since organic EL devices are self-light-emitting devices that emit light by themselves, illuminating members are not necessary and thus weight-lightening and thinning can be easily achieved. Furthermore, since the response speed of organic EL devices is very high, such as about several microseconds, residual images at the time when moving images are displayed are not generated.

Among flat- and self-light-emitting-type display apparatuses in which organic EL devices are used in pixels, in particular, development of active-matrix-type display apparatuses in which thin-film transistors are integrated and formed as driving devices in each of pixels has been actively conducted. Active-matrix-type flat and self-light-emitting display apparatuses are described, for example, in patent documents 1 to 5 listed below.

[Patent Document 1] Japanese Unexamined Patent Application Publication No. 2003-255856

[Patent Document 2] Japanese Unexamined Patent Application Publication No. 2003-271095

[Patent Document 3] Japanese Unexamined Patent Application Publication No. 2004-133240

[Patent Document 4] Japanese Unexamined Patent Application Publication No. 2004-029791

[Patent Document 5] Japanese Unexamined Patent Application Publication No. 2004-093682

FIG. 24 is a schematic circuit diagram showing an example of a known active-matrix-type display apparatus. The display apparatus is constituted by a pixel array unit 1 and peripheral driving units. The driving units include a horizontal selector 3 and a write scanner 4. The pixel array unit 1 includes signal lines SL in columns and scanning lines WS in rows. Pixels 2 are arranged in portions where respective signal lines SL and respective scanning lines WS intersect with each other. For the sake of easier understanding, only one pixel 2 is illustrated in the figure. The write scanner 4 includes shift registers. The write scanner 4 operates in accordance with clock signals ck that are supplied from the outside and sequentially transfers start pulses sp that are also supplied from the outside, so that the write scanner 4 sequentially outputs control signals to the scanning lines WS. The horizontal selector 3 supplies video signals to the signal lines SL in accordance with line-sequential scanning by the write scanner 4.

The pixels 2 are each constituted by a sampling transistor T1, a driving transistor T2, a holding capacitor C1, and a light-emitting device EL. The driving transistor T2 is of a P-channel type. The source of the driving transistor T2 is connected to a power supply line, and the drain of the driving transistor T2 is connected to the light-emitting device EL. The gate of the driving transistor T2 is connected to a signal line SL with the sampling transistor T1 therebetween. The sampling transistor T1 is brought into conduction in accordance with a control signal supplied from the write scanner 4, and samples a video signal supplied from the signal line SL to write the video signal to the holding capacitor C1. The driving transistor T2 receives as a gate voltage Vgs, at the gate thereof, the video signal written to the holding capacitor C1, and causes a drain current Ids to flow to the light-emitting device EL. Accordingly, the light-emitting device EL emits light at a brightness corresponding to the video signal. The gate voltage Vgs represents the potential of the gate, which is based on the source.

The driving transistor T2 operates in a saturation region. The relationship between the gate voltage Vgs and the drain current Ids is represented by the following characteristic equation:

$$Ids=(1/2)\mu(W/L)Cox(Vgs-Vth)^2,$$

where μ represents the mobility of the driving transistor, W represents the channel width of the driving transistor, L represents the channel length of the driving transistor, Cox represents the gate insulation capacitance of the driving transistor, and Vth represents the threshold voltage of the driving transistor. As is clear from the characteristic equation, in a case where the driving transistor T2 operates in the saturation region, the driving transistor T2 functions as a constant-current source that supplies the drain current Ids in accordance with the gate voltage Vgs.

FIG. 25 is a graph showing the voltage/current characteristics of the light-emitting device EL. The abscissa represents an anode voltage V, and the ordinate represents the driving current Ids. In addition, the anode voltage of the light-emitting device EL is the drain voltage of the driving transistor T2. The current/voltage characteristics of the light-emitting device EL change with time, and the characteristic curve tends to become flatter as time passes. Thus, even if the driving current Ids is constant, the anode voltage (drain voltage) V changes. In this respect, in the pixel circuit 2 shown in FIG. 24, since the driving transistor T2 operates in the saturation region and the driving current Ids corresponding to the gate voltage Vgs can thus be caused to flow irrespective of a variation in the drain voltage, a constant light-emission brightness can be maintained irrespective of a time-lapse change in the characteristics of the light-emitting device EL.

FIG. 26 is a circuit diagram showing another example of a known pixel circuit. A difference from the pixel circuit shown above in FIG. 24 is that the driving transistor T2 is changed from being of the P-channel type to being of an N-channel type. In terms of the manufacturing process of a circuit, it is often advantageous to use N-channel-type transistors for all the transistors forming a pixel.

DISCLOSURE OF INVENTION

Technical Problem

However, in reality, device characteristics of thin-film transistors (TFTs) formed of semiconductor thin films made of polysilicon or the like vary individually. In particular, the threshold voltage Vth is not constant, and the threshold voltage Vth varies among pixels. As is clear from the above-described transistor characteristic equation, in the case that the threshold voltage Vth of respective driving transistors varies, even if the gate voltage Vgs is constant, the drain current Ids varies and the brightness varies among the pixels, thus deteriorating screen uniformity. A pixel circuit incorporated with a function of canceling a variation in the threshold voltage among driving transistors has been developed, and the disclosure thereof is provided, for example, in the above-mentioned patent document 3.

In addition to the threshold voltage Vth, a variation also appears in the mobility μ of thin-film transistors. As is clear from the above-described transistor characteristic equation, in the case that the mobility μ of respective driving transistors varies, even if the gate voltage Vgs is constant, a variation appears in the drain current Ids and the brightness varies among the pixels, thus deteriorating the screen uniformity. A pixel circuit incorporated with a function of canceling a variation in the mobility, as well as a variation in the threshold voltage of driving transistors, has also been developed.

In a non-light emission period, which is before each pixel enters a light-emission period, a known display apparatus performs, for each pixel, a threshold-voltage correction operation and a mobility correction operation on a driving transistor. At this time, in order to perform each of the correction operations normally, a node for connecting the driving transistor and the light-emitting device together (in this specification, hereinafter, may be referred to as an output node) is maintained at a potential in a minus direction and the light-emitting device is put in a reverse-biased state. However, in a case where the reverse-biased state in the non-light-emission period is excessive, the light-emitting device is damaged. In the worst case, this may result in the light-emitting device not being able to emit light, and a so-called black-spot defect may occur in the pixel.

Technical Solution

In light of the above-described known technical problem, an object of the present invention is to provide a display apparatus in which a reverse bias is not applied to a light-emitting device in a non-light-emission period of a pixel and a driving method for such a display apparatus. In order to achieve the above-mentioned object, the means described below are implemented. That is, a display apparatus according to the present invention is characterized by including scanning lines in rows, signal lines in columns, and pixels arranged in a matrix in portions where the scanning lines and the signal lines intersect with each other. The pixels each include at least a sampling transistor, a driving transistor having an input node and an output node, a switching transistor, a light-emitting device, a holding capacitor, and an auxiliary capacitor. The sampling transistor is arranged between the signal line and the input node, is brought into conduction in accordance with a control signal supplied from the scanning line, and writes to the holding capacitor a video signal supplied from the signal line. The driving transistor outputs a driving current to the output node in accordance with a signal potential of the video signal written to the holding capacitor. The holding capacitor is arranged between the input node and the output node. The auxiliary capacitor is connected to the output node. The switching transistor is arranged between the output node and the light-emitting device, and in a predetermined light-emission period, the switching transistor is in an on-state and supplies the driving current to the light-emitting device to cause the light-emitting device to emit light at a brightness corresponding to the video signal, whereas in a non-light-emission period, the switching transistor is turned off to disconnect the light-emitting device from the output node, so that a potential generated at the output node due to an operation of the pixel performed in the non-light-emission period is prevented from being applied as a reverse-bias voltage to the light-emitting device of a diode type.

According to an aspect, a gate of the driving transistor is connected to the input node, a drain of the driving transistor is connected to a power supply line, and a source of the driving transistor is connected to the output node. An anode of the light-emitting device is connected to the output node with the switching transistor therebetween, and a cathode of the light-emitting device is connected to a ground line. The auxiliary capacitor is connected between the output node and the ground line. In addition, the pixels each include threshold-voltage correction means. The threshold-voltage correction means operates in the non-light-emission period. In a state where a potential exceeding the reverse-bias voltage is applied to the output node, the threshold-voltage correction means causes a voltage corresponding to a threshold voltage of the driving transistor to be held in the holding capacitor between the input node and the output node. Furthermore, the pixels each include mobility correction means. The mobility correction means operates when the video signal is being written in the non-light-emission period. In a state where electricity exceeding the reverse-bias voltage is applied to the output node, the mobility correction means negatively feeds back the driving current from the output node to the holding capacitor, thereby applying correction corresponding to a mobility of the driving transistor.

Advantageous Effects

According to the present invention, each pixel is constituted by, for example, three transistors, two capacitors, and one light-emitting device, and has a relatively simple configuration. Thus, an increase in the definition, an increase in the yield, and a decrease in the cost of a display apparatus can be achieved. In addition, even with a simple component-configuration, a threshold-voltage correction operation and a mobility correction operation of a driving transistor can be performed in a non-light-emission period, thus achieving a display apparatus having a high screen-uniformity. Here, in a case where each pixel performs a correction operation, it is necessary to apply a voltage in a minus direction to an output node of the driving transistor. Thus, in order to prevent a reverse bias from being applied to the light-emitting device, a switching device is inserted between the output node of the driving transistor and the light-emitting device. In the non-light-emission period, the switching device is turned off to disconnect the light-emitting device from the output node, to which a minus voltage is applied. This prevents the light-emitting device from being put in a reverse-biased state, thus suppressing damage and destruction of the light-emitting device and preventing a black-spot defect from occurring in the pixel. With this configuration, the yield of a display apparatus can further be improved.

BEST MODES FOR CARRYING OUT THE INVENTION

Figure 1:
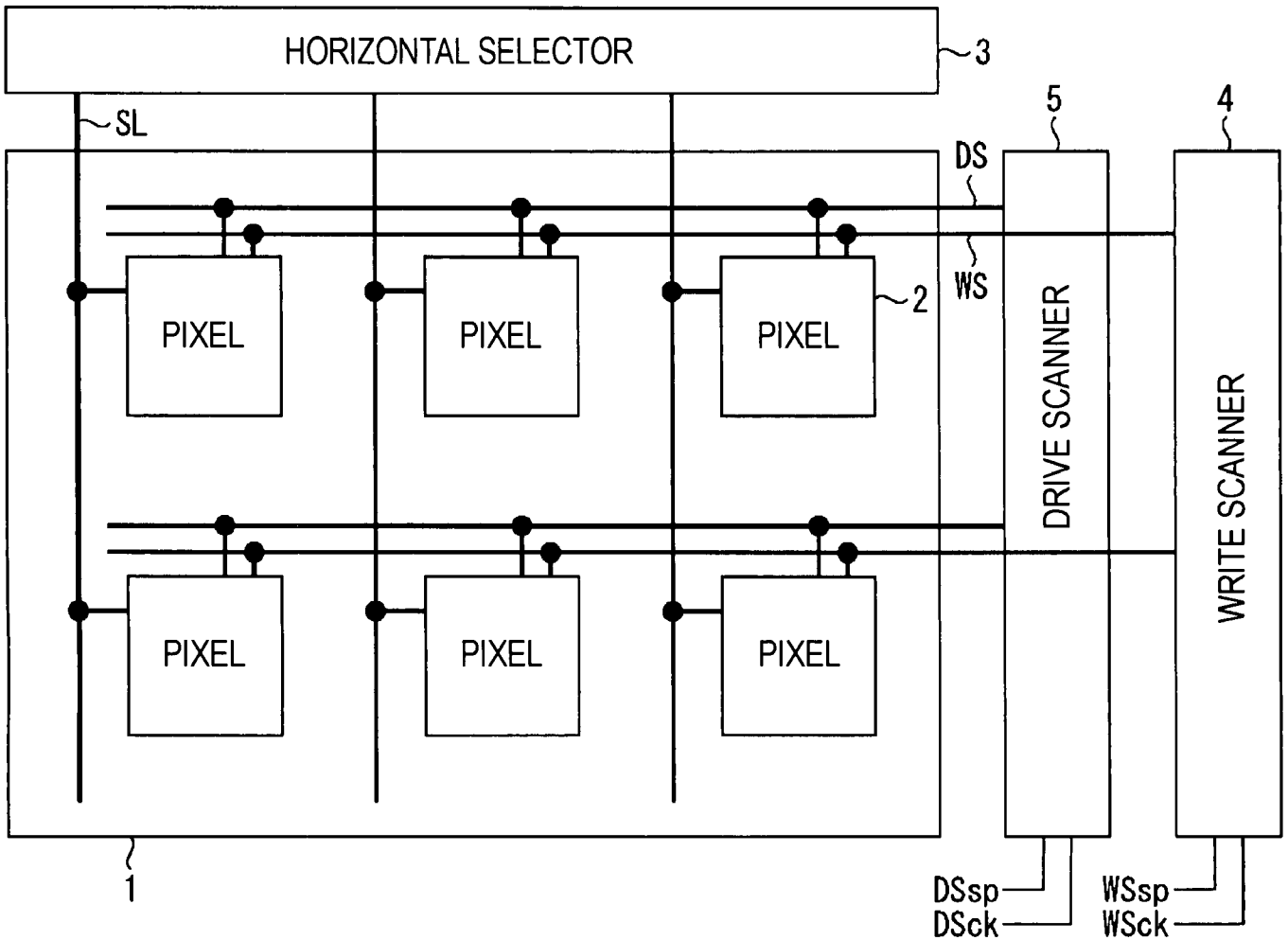
FIG. 1 is a block diagram showing the entire configuration of a display apparatus according to preceding development.

Embodiments of the present invention will be described hereinafter with reference to the drawings. First, in order to facilitate understanding of the present invention and to clarify the background, a display apparatus according to preceding development, on which the present invention is based, will be briefly explained. FIG. 1 is a block diagram showing the entire configuration of a display apparatus according to preceding development. This display apparatus includes a pixel array unit 1 and driving units (3, 4, 5) driving the pixel array unit 1. The pixel array unit 1 includes scanning lines WS in rows, signal lines SL in columns, pixels 2 arranged in a matrix in portions where the scanning lines WS and the signal lines SL intersect with each other, and power feed lines DS arranged in association with individual rows of respective pixels 2. The driving units (3, 4, 5) include a control scanner (write scanner) 4 for sequentially supplying control signals to individual scanning lines WS and performing line-sequential scanning of the pixels 2 in units of rows, a power supply scanner (drive scanner) 5 for supplying power supply voltages, which are switched between a first potential and a second potential, to individual power feed lines DS in accordance with the line-sequential scanning, and a signal selector (horizontal selector) 3 for supplying a signal potential serving as a video signal and a reference potential to the signal lines SL in columns in accordance with the line-sequential scanning. The write scanner 4 operates in accordance with clock signals WSck that are supplied from the outside, and sequentially transfers start pulses WSsp that are also supplied from the outside, so that the write scanner 4 outputs control signals to individual scanning lines WS. The drive scanner 5 operates in accordance with clock signals DSck that are supplied from the outside, and sequentially transfers start pulses DSsp that are also supplied from the outside, so that the drive scanner 5 line-sequentially switches the potentials of the power feed lines DS.

Figure 2:
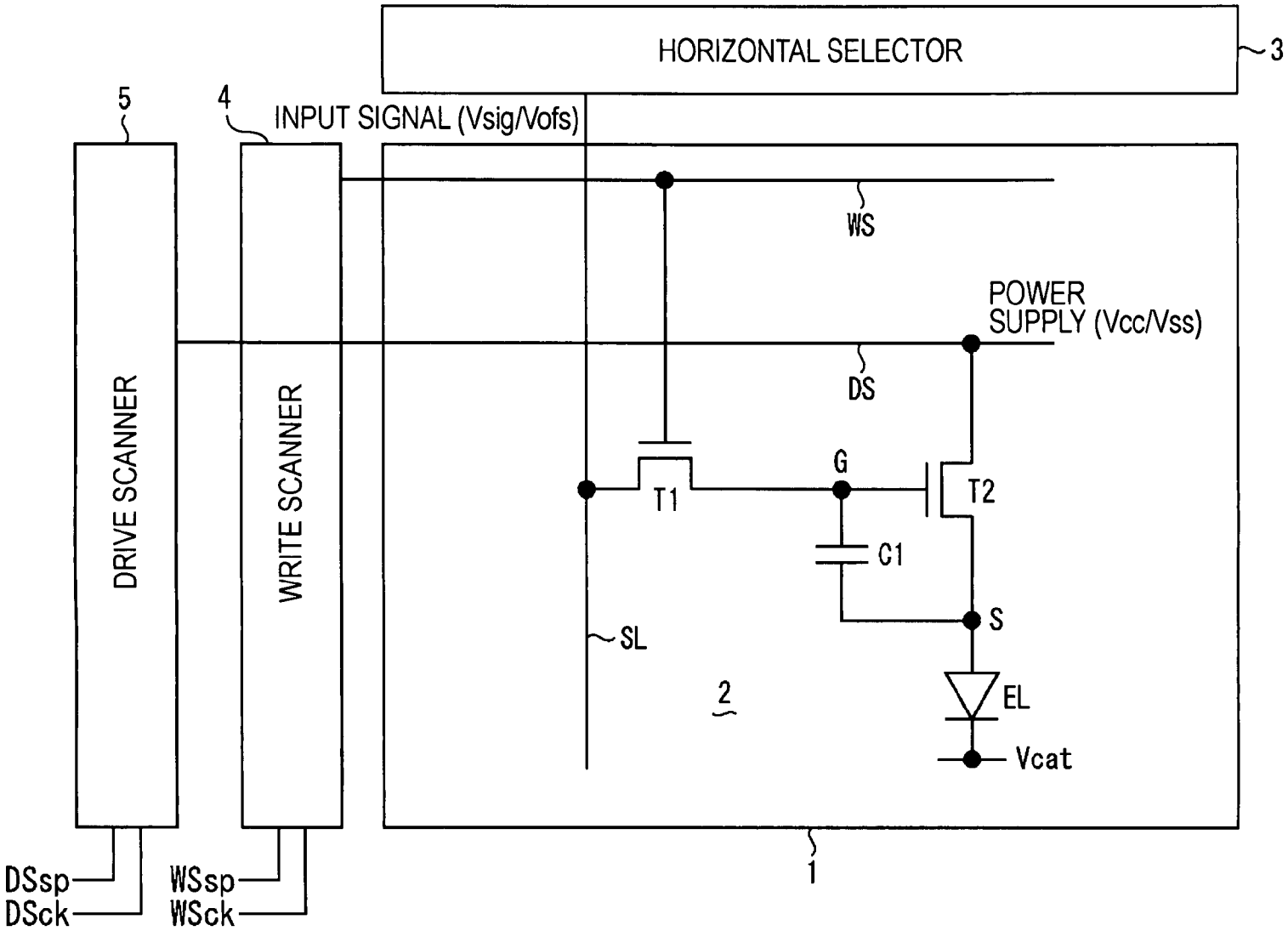
FIG. 2 is a circuit diagram showing the configuration of a pixel incorporated in the display apparatus shown in FIG. 1.

FIG. 2 is a circuit diagram showing a concrete configuration of a pixel 2 included in the display apparatus shown in FIG. 1. As shown in the figure, this pixel circuit 2 is constituted by a two-terminal-type (diode-type) light-emitting device EL, which is typified by an organic EL device or the like, an N-channel-type sampling transistor T1, a similar N-channel-type driving transistor T2, and a thin-film-type holding capacitor C1. The gate of the sampling transistor T1 is connected to a scanning line WS, one of the source and the drain of the sampling transistor T1 is connected to a signal line SL, and the other one of the source and the drain of the sampling transistor T1 is connected to the gate G (input node) of the driving transistor T2. That is, the gate G of the driving transistor T2 serves as an input node for the sampling transistor T1. One of the source and the drain of the driving transistor T2 is connected to the light-emitting device EL, and the other one of the source and the drain of the driving transistor T2 is connected to a power feed line DS. In this embodiment, the driving transistor T2 is of the N-channel type, the drain side is connected to the power feed line DS, and the source S side is connected to the anode side of the light-emitting device EL. The source S side serves as an output node for the light-emitting device EL. The cathode of the light-emitting device EL is fixed at a predetermined cathode potential Vcat. The holding capacitor C1 is connected between the source S and the gate G of the driving transistor T2. To the pixels 2 having such a configuration, the control scanner (write scanner) 4 sequentially outputs control signals by switching the scanning lines WS between a low potential and a high potential, and performs line-sequential scanning of the pixels 2 in units of rows. The power supply scanner (drive scanner) 5 supplies a power supply voltage switching between a first potential Vcc and a second potential Vss to each power feed line DS in accordance with the line-sequential scanning. The signal selector (horizontal selector) 3 supplies a signal potential Vsig serving as a video signal and a reference potential Vofs to the signal lines SL in columns in accordance with the line-sequential scanning.

With this configuration, the sampling transistor Tr1 is brought into conduction in accordance with a control signal supplied from the scanning line WS, and samples a signal potential Vsig supplied from the signal line SL to cause the signal potential Vsig to be held in the holding capacitor C1. The driving transistor T2 receives a current supplied from the power feed line DS at the first potential Vcc, and causes a driving current to flow to the light-emitting device EL in accordance with the signal potential Vsig held in the holding capacitor C1. In order to allow the sampling transistor T1 to be in a conductive state in a time period when the signal line SL has the signal potential Vsig, the control scanner 4 outputs a control signal of a predetermined time width to the scanning line WS. Thus, the signal potential Vsig is held in the holding capacitor C1, and at the same time, correction for the mobility μ of the driving transistor T2 is applied to the signal potential Vsig.

The pixel circuit shown in FIG. 2 has a threshold-voltage correction function, as well as the above-described mobility correction function. That is, before the sampling transistor T1 samples the signal potential Vsig, the power supply scanner (drive scanner) 5 switches the power feed line DS from the first potential Vcc to the second potential Vss at a first timing. Similarly, before the sampling transistor T1 samples the signal potential Vsig, the control scanner (write scanner) 4 allows the sampling transistor T1 to be brought into conduction to apply the reference potential Vofs from the signal line SL to the gate G of the driving transistor T2 and sets the source S of the driving transistor T2 at the second potential Vss at a second timing. At a third timing, which is subsequent to the second timing, the power supply scanner (drive scanner) 5 switches the power feed line DS from the second potential Vss to the first potential Vcc, and causes a voltage corresponding to a threshold voltage Vth of the driving transistor T2 to be held in the holding capacitor C1. Due to such a threshold-voltage correction function, this display apparatus is capable of cancelling the influence of the threshold voltage Vth of the driving transistor T2 varying among pixels. In addition, the order of the first timing and the second timing is not an issue.

The pixel circuit 2 shown in FIG. 2 also has a bootstrap function. That is, at a point in time when the signal potential Vsig is held in the holding capacitor C1, the write scanner 4 causes the sampling transistor T1 to be in a nonconductive state to electrically disconnect the gate G of the driving transistor T2 from the signal line SL. Thus, the gate potential is in conjunction with a variation in the source potential of the driving transistor T2, and the voltage Vgs between the gate G and the source S is maintained constant. Even if the current/voltage characteristics of the light-emitting device EL vary with time, the gate voltage Vgs can be maintained constant. Thus, brightness does not change.

Figure 3:
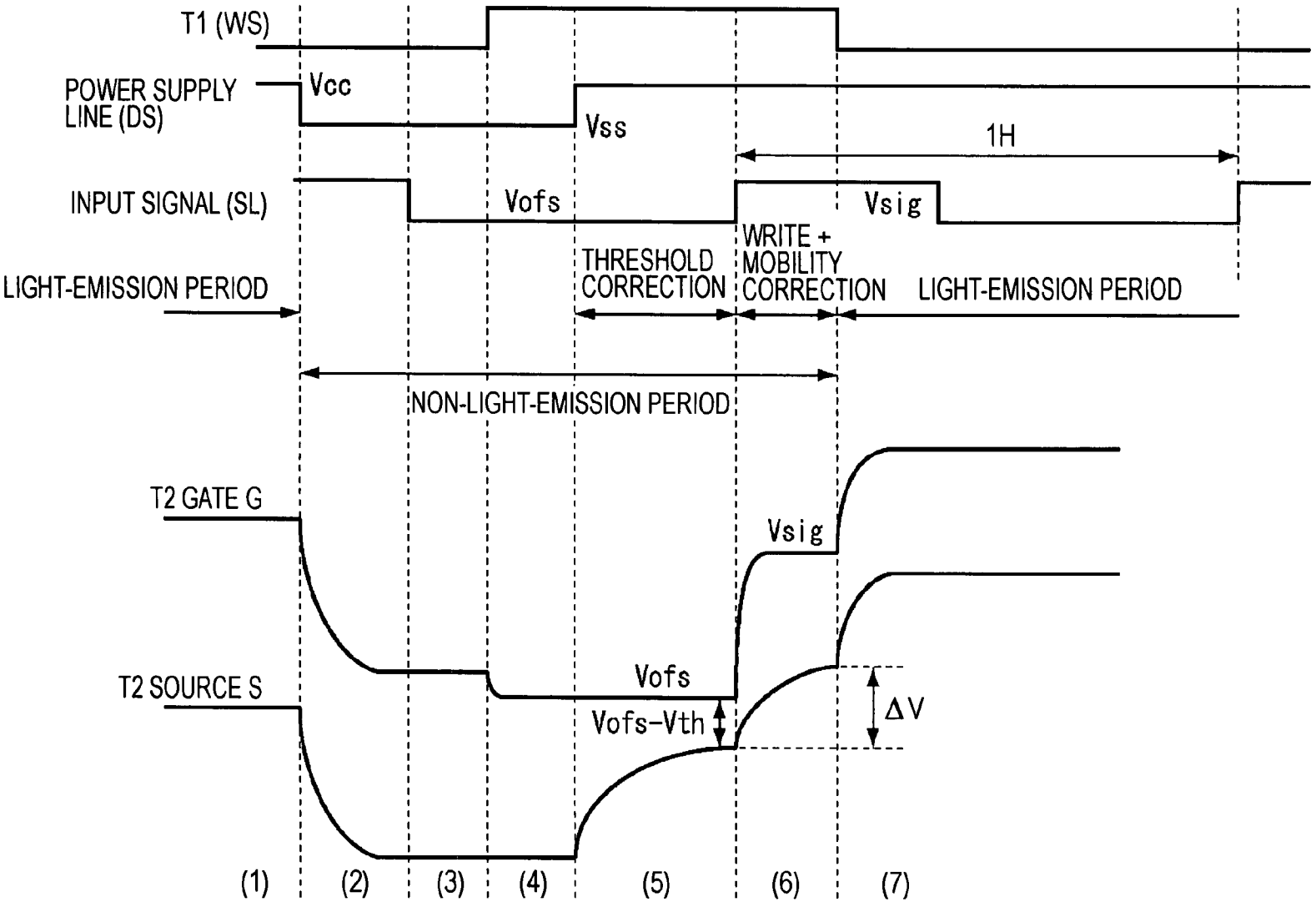
FIG. 3 is a timing chart provided for explaining operations of the pixel shown in FIG. 2.

FIG. 3 is a timing chart provided for explaining operations of the pixel shown in FIG. 2. Here, this timing chart is an example, and the control sequence of the pixel circuit shown in FIG. 2 is not limited to the timing chart of FIG. 3. This timing chart represents a change in the potential of the scanning line WS, a change in the potential of the power feed line DS, and a change in the potential of the signal line SL, using a common time base. The change in the potential of the scanning line WS represents a control signal, which performs opening/closing control of the sampling transistor T1. The change in the potential of the power feed line DS represents switching between the power supply voltages Vcc and Vss. In addition, the change in the potential of the signal line SL represents switching between the signal potential Vsig and the reference potential Vofs of an input signal. In addition, in parallel to these changes in potentials, changes in the potentials of the gate G and the source S of the driving transistor T2 are also represented. As described above, the potential difference between the gate G (input node) and the source S (output node) is Vgs.

In this timing chart, periods are divided into (1) to (7) in accordance with transition of operations of the pixel, for the sake of convenience. In the period (1), which is immediately before entering the corresponding field, the light-emitting device EL is in a light-emission state. Then, in the first period (2) after one field for line-sequential scanning starts, the power feed line DS is switched from the first potential Vcc to the second potential Vss. The next period (3) starts, and an input signal is switched from Vsig to Vofs. Furthermore, in the next period (4), the sampling transistor T1 is turned on. In the periods (2) to (4), the gate voltage and the source voltage of the driving transistor T2 are initialized. The periods (2) to (4) are preparation periods for threshold-voltage correction. The gate G of the driving transistor T2 is initialized to Vofs, whereas the source S is initialized to Vss. Then, in the threshold-correction period (5), an actual threshold-voltage correction operation is performed, and a voltage corresponding to the threshold voltage Vth is held between the gate G and the source S of the driving transistor T2. In reality, the voltage corresponding to Vth is written to the holding capacitor C1, which is connected between the gate G and the source S of the driving transistor T2. After that, the write period/mobility correction period (6) starts. Here, the signal potential Vsig of the video signal is written to the holding capacitor C1 so as to be supplemented to Vth, and a voltage ΔV for mobility correction is subtracted from the voltage held in the holding capacitor C1. In the write period/mobility correction period (6), it is necessary to cause the sampling transistor T1 to be in the conductive state in a time period when the signal line SL has the signal potential Vsig. Then, the light-emission period (7) starts, and the light-emitting device emits light at a brightness corresponding to the signal potential Vsig. On this occasion, since the signal potential Vsig is adjusted by the voltage corresponding to the threshold voltage Vth and the voltage ΔV for mobility correction, the light-emission brightness of the light-emitting device EL is not affected by variations in the threshold voltage Vth and the mobility μ of the driving transistor T2. In addition, a bootstrap operation is performed at the beginning of the light-emission period (7). While the voltage Vgs between the gate G and the source S of the driving transistor T2 is maintained constant, the gate potential and the source potential of the driving transistor T2 increase.

Figure 4:
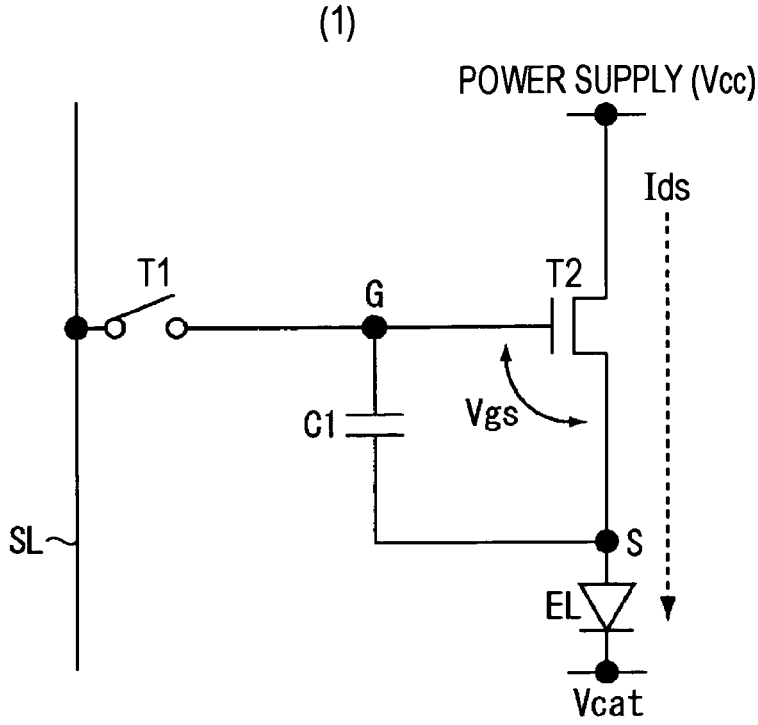
FIG. 4 is a schematic diagram also provided for explaining an operation of the pixel shown in FIG. 2.

Continuously, the operations of the pixel circuit shown in FIG. 2 will be explained in detail with reference to FIGS. 4 to 11. First, as shown in FIG. 4, in the light-emission period (1), the power supply potential is set to Vcc, and the sampling transistor T1 is turned off. Here, since the driving transistor T2 is set to operate in the saturation region, the driving current Ids flowing to the light-emitting device EL has a value represented by the above-described transistor characteristic equation in accordance with the voltage Vgs applied between the gate G and the source S of the driving transistor T2.

Figure 5:
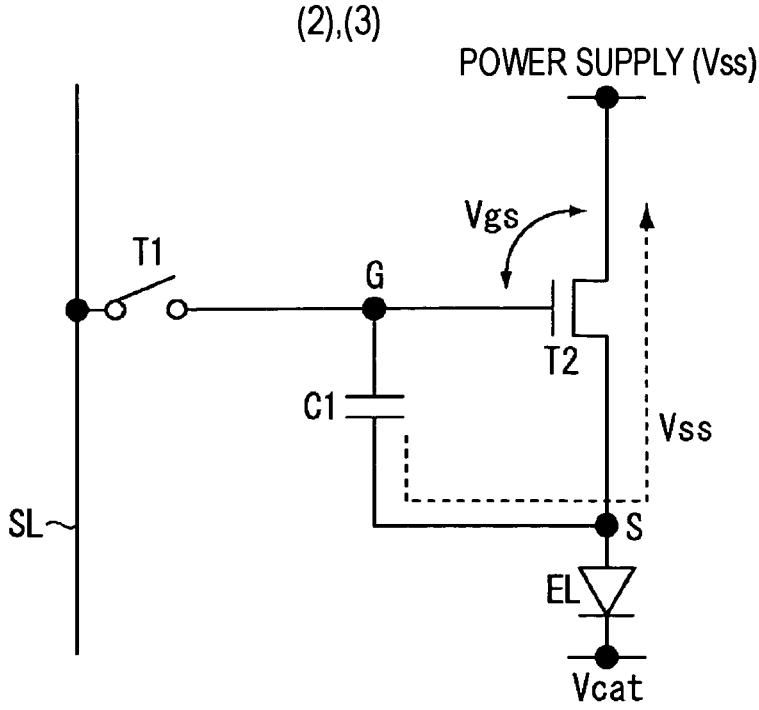
FIG. 5 is a schematic diagram also provided for explaining an operation.

Then, as shown in FIG. 5, the preparation periods (2) and (3) start, and the potential of the power feed line (power supply line) is set to Vss. Here, Vss is set to be smaller than the sum of the threshold voltage Vthel and the cathode voltage Vcat of the light-emitting device EL. That is, since Vss<Vthel+Vcat, the light-emitting device EL turns off the light, and the power supply side serves as the source of the driving transistor T2. At this time, the anode of the light-emitting device EL is charged to Vss.

Figure 6:
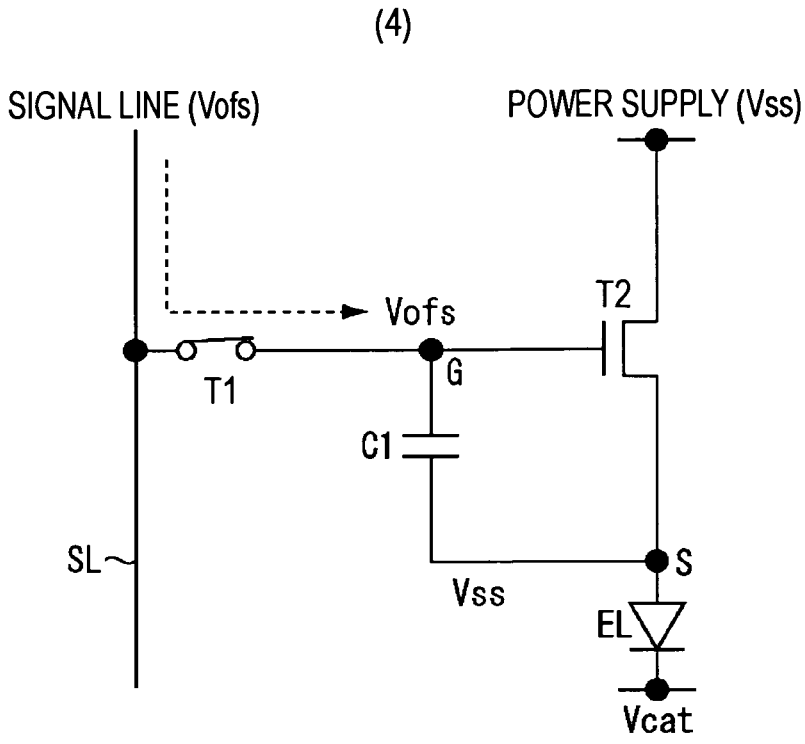
FIG. 6 is a schematic diagram also provided for explaining an operation.

Furthermore, as shown in FIG. 6, when the next preparation period (4) starts, the potential of the signal line SL exhibits Vofs, whereas the sampling transistor T1 is turned on to cause the gate potential of the driving transistor T2 to exhibit Vofs. As stated above, the source S and the gate G of the driving transistor T2 are initialized, and the gate voltage Vgs at this time exhibits a value, Vofs−Vss. Vgs=Vofs−Vss is set to a value greater than the threshold voltage Vth of the driving transistor T2. Since the driving transistor T2 is initialized to satisfy Vgs>Vth as described above, preparation for the subsequent threshold-voltage correction operation is completed.

Figure 7:
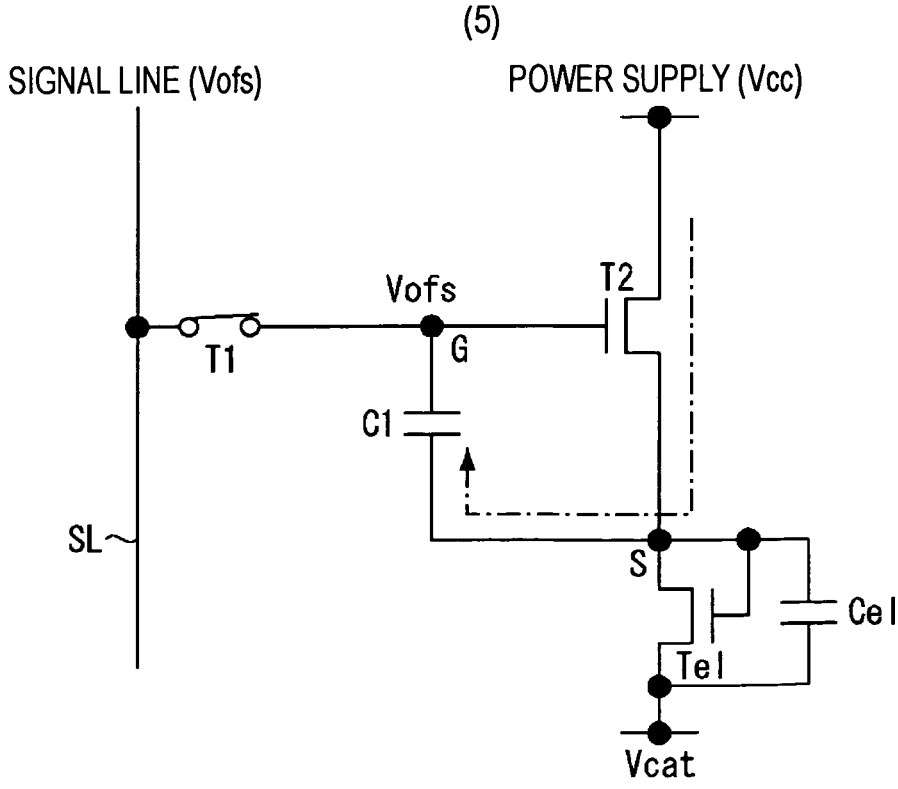
FIG. 7 is a schematic diagram also provided for explaining an operation.

Then, as shown in FIG. 7, the threshold-voltage correction period (5) starts, and the potential of the power feed line DS (power supply line) is returned to Vcc. Since the power supply voltage is set to Vcc, the anode of the light-emitting device EL serves as the source S of the driving transistor T2, and a current flows as shown in the figure. Here, an equivalent circuit of the light-emitting device EL can be represented by parallel connection of a diode Tel and a capacitor Cel, as shown in the figure. Since the anode potential (that is, the source potential Vss) is lower than Vcat+Vthel, the diode Tel is in an off-state, and a leak current flowing in the diode Tel is significantly smaller than the current flowing in the driving transistor T2. Thus, almost all the current flowing in the driving transistor T2 is used for charging the holding capacitor C1 and the equivalent capacitor Cel.

Figure 8:
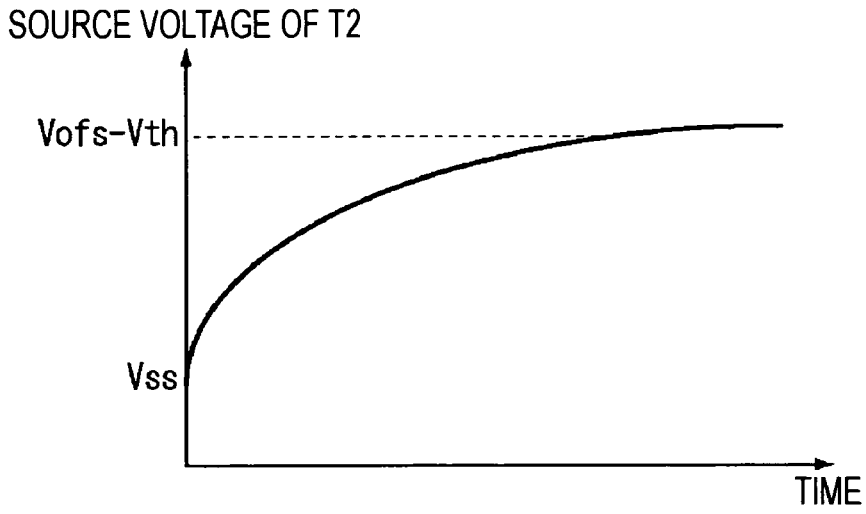
FIG. 8 is a graph also provided for explaining the operation.

FIG. 8 represents a change with time of the source voltage of the driving transistor T2 in the threshold-voltage correction period (5) shown in FIG. 7. As shown in the figure, the source voltage of the driving transistor T2 (that is, the anode voltage of the light-emitting device EL) increases with time from Vss. After the threshold-voltage correction period (5) passes, the driving transistor T2 enters cutoff, and the voltage Vgs between the source S and the gate G thereof reaches Vth. Here, the source potential is applied as Vofs−Vth. This value Vofs−Vth is still lower than Vcat+Vthel, and the light-emitting device EL is in a cut-off state.

Figure 9:
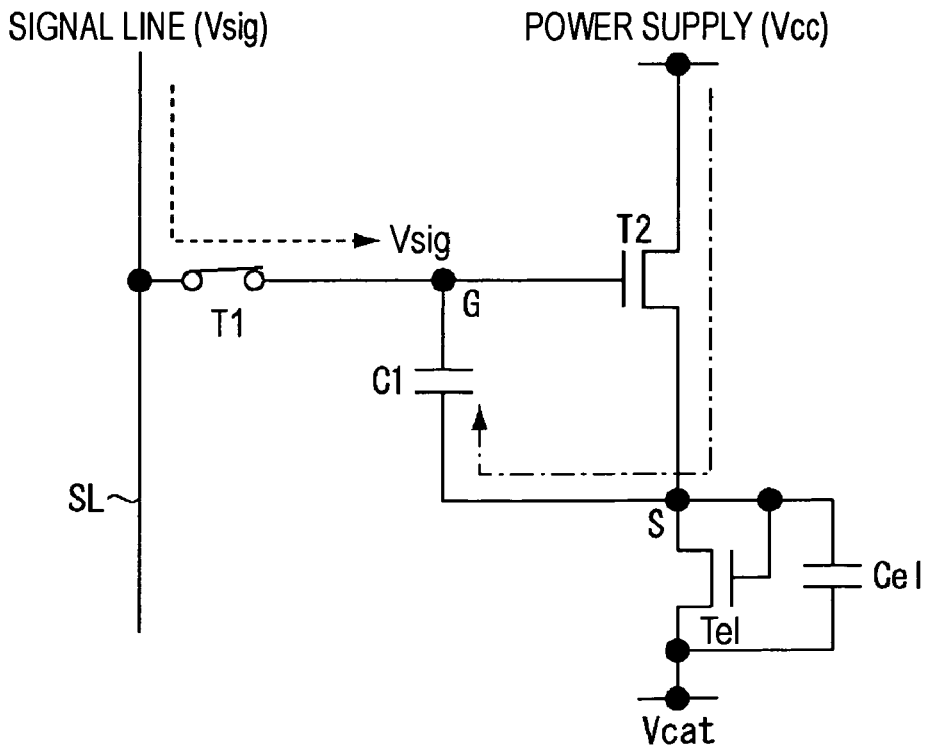
FIG. 9 is a schematic diagram also provided for explaining an operation.

Then, as shown in FIG. 9, the write period/mobility correction period (6) starts, and the potential of the signal line SL is switched from Vofs to Vsig in a state where the sampling transistor T1 is continuously turned on. Here, the signal potential Vsig exhibits a voltage corresponding to a grayscale level. Since the sampling transistor T1 is turned on, the gate potential of the driving transistor T2 exhibits Vsig. In contrast, since a current flows from the power supply Vcc, the source potential increases with time. At this point in time, since the source potential of the driving transistor T2 also does not exceed the sum of the threshold voltage Vthel and the cathode voltage Vcat of the light-emitting device EL, the current flowing from the driving transistor T2 is used only for charging the equivalent capacitor Cel and the holding capacitor C1. Here, since the threshold-voltage correction operation of the driving transistor T2 has already been completed, the current flowing from the driving transistor T2 reflects the mobility μ. Specifically, for the driving transistor T2 having a large mobility μ, the amount of current at this time is large, and the potential increase amount ΔV at the source is also large. In contrast, in the case that the mobility μ is small, the amount of current of the driving transistor T2 is small, and the increase amount ΔV at the source is small. With such an operation, the gate voltage Vgs of the driving transistor T2 reflects the mobility μ and is compressed by ΔV. At a point in time after the mobility correction period (6) is completed, Vgs obtained by completely correcting the mobility μ can be acquired.

Figure 10:
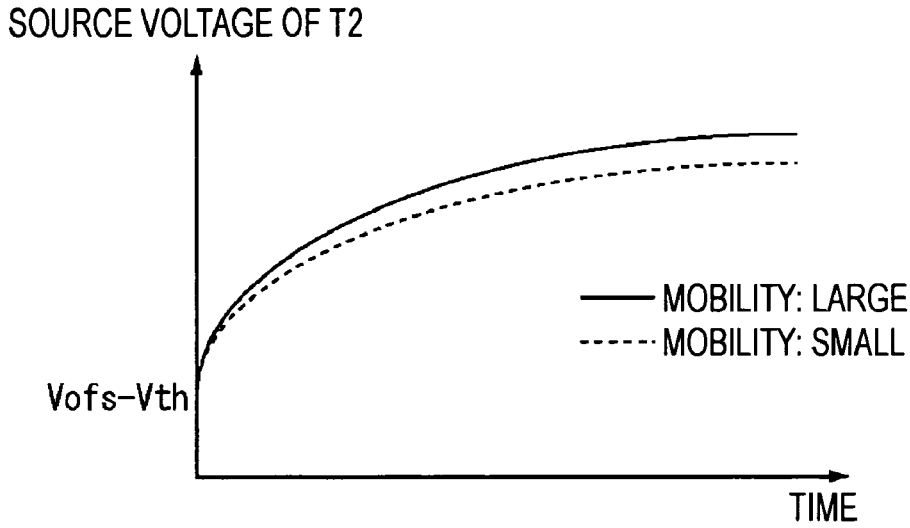
FIG. 10 is a graph also provided for explaining the operation.

FIG. 10 is a graph showing a temporal change in the source voltage of the driving transistor T2 in the above-described mobility correction period (6). As shown in the figure, in the case that the mobility of the driving transistor T2 is large, the source voltage increases quickly, and Vgs is compressed correspondingly. That is, in the case that the mobility μ is large, Vgs is compressed so that the influence of the large mobility μ is canceled, and the driving current can be suppressed. In contrast, in the case that the mobility μ is small, since the source voltage of the driving transistor T2 does not increase very quickly, Vgs is not subjected to high compression. Thus, in the case that the mobility μ is small, large compression is not applied to Vgs of the driving transistor so as to compensate for a small driving capability.

Figure 11:
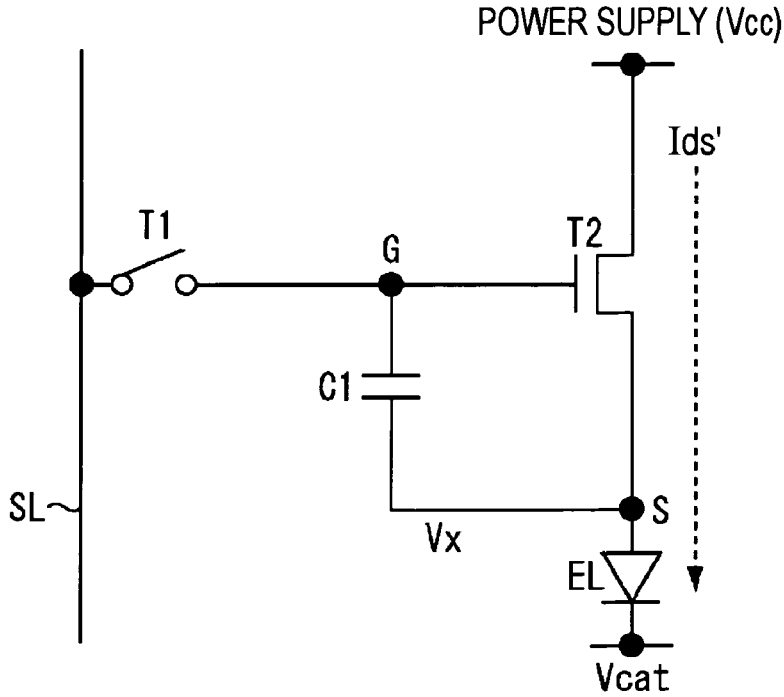
FIG. 11 is a schematic diagram also provided for explaining an operation.

FIG. 11 represents an operating state in the light-emission period (7). In the light-emission period (7), the sampling transistor T1 is turned off and causes the light-emitting device EL to emit light. The gate voltage Vgs of the driving transistor T2 is maintained constant, and the driving transistor T2 causes a constant current Ids' to flow to the light-emitting device EL in accordance with the above-described characteristic equation. Since the current Ids' flows to the light-emitting device EL, the anode voltage of the light-emitting device EL (that is, the source voltage of the driving transistor T2) increases to Vx and at a point in time when the anode voltage of the light-emitting device EL exceeds Vcat+Vthel, the light-emitting device EL emits light. If the light-emitting device EL emits light for a long time, the current/voltage characteristics of the light-emitting device EL change. Thus, the potential of the source S shown in FIG. 11 changes. However, since the gate voltage Vgs of the driving transistor T2 is maintained constant due to the bootstrap operation, the current Ids' flowing to the light-emitting device EL does not change. Thus, even if the current/voltage characteristics of the light-emitting device EL are deteriorated, the constant driving current Ids' always flows, and the brightness of the light-emitting device EL does not change.

Now, a reverse-biased state of the light-emitting device EL will be described. As described above, after the light-emission period (1) for the previous field ends, the non-light-emission periods (2) to (6) for the present field start, and the threshold-voltage correction operation and the mobility correction operation are performed, the pixel circuit 2 reaches the light-emission period (7) for the present field. In the preparation periods (2) to (4) within the non-light-emission periods, the source S of the driving transistor T2 (output node) is set to the lowest potential Vss, and the light-emitting device EL becomes reversely biased. That is, before the threshold-voltage correction period (5), the amount of reverse bias applied to the light-emitting device EL is the largest, and the value is Vss. In the preparation period (4), the gate G of the driving transistor T2 (input node) is set to Vofs, and the source S (output node) is set to Vss. In order to normally perform the subsequent threshold-voltage correction operation, it is necessary to set the voltage Vgs=Vofs−Vss between the gate G and the source S to be larger than the threshold-voltage width of the driving transistor T2. That is, it is necessary to set Vofs and Vss so as to satisfy Vofs−VthMAX<Vofs−Vss. Here, VthMAX represents the maximum threshold voltage of a driving transistor included in each pixel in the pixel array.

As stated above, after the reverse-bias voltage Vss is applied to the anode of the light-emitting device EL in the preparation periods (2) to (4), the threshold-voltage correction operation, the video-signal writing operation, and the mobility correction operation are performed. In order to normally complete the operations until the mobility correction operation, at a point in time after the mobility correction period (6) ends, that is, immediately before the light-emission period (7), it is necessary to cause the light-emitting device EL to be in the reverse-biased state, and the voltage applied to the anode of the light-emitting device EL must be smaller than or equal to the threshold voltage Vthel of the light-emitting device EL. In order to ensure this, the relationship described below must be satisfied. That is, in a case where the video-signal writing operation at the maximum brightness level (white display) and the mobility correction operation are performed, when the potential increase amount (mobility correction amount) at the anode of the light-emitting device EL is ΔV, the following relationship must be satisfied:

$$Vofs-Vth\mathrm{MIN}>Vthel+Vcat-\Delta V,$$

where VthMIN represents the minimum threshold voltage of a driving transistor included in each pixel in the pixel array. As stated above, in the non-light-emission periods, the output node of the driving transistor T2 exhibits a level at which the light-emitting device EL is in the reverse-biased state. From the opposite point of view, it is necessary to set Vofs and Vss in advance so that the light-emitting device EL is in the reverse-biased state in the non-light-emission periods. However, if the reverse-bias voltage applied to the light-emitting device EL is large, the light-emitting device EL is damaged. In the worst case, this may result in the light-emitting device EL not being able to emit light, and a black-spot defect may occur in a pixel, which is problematic.

Figure 12:
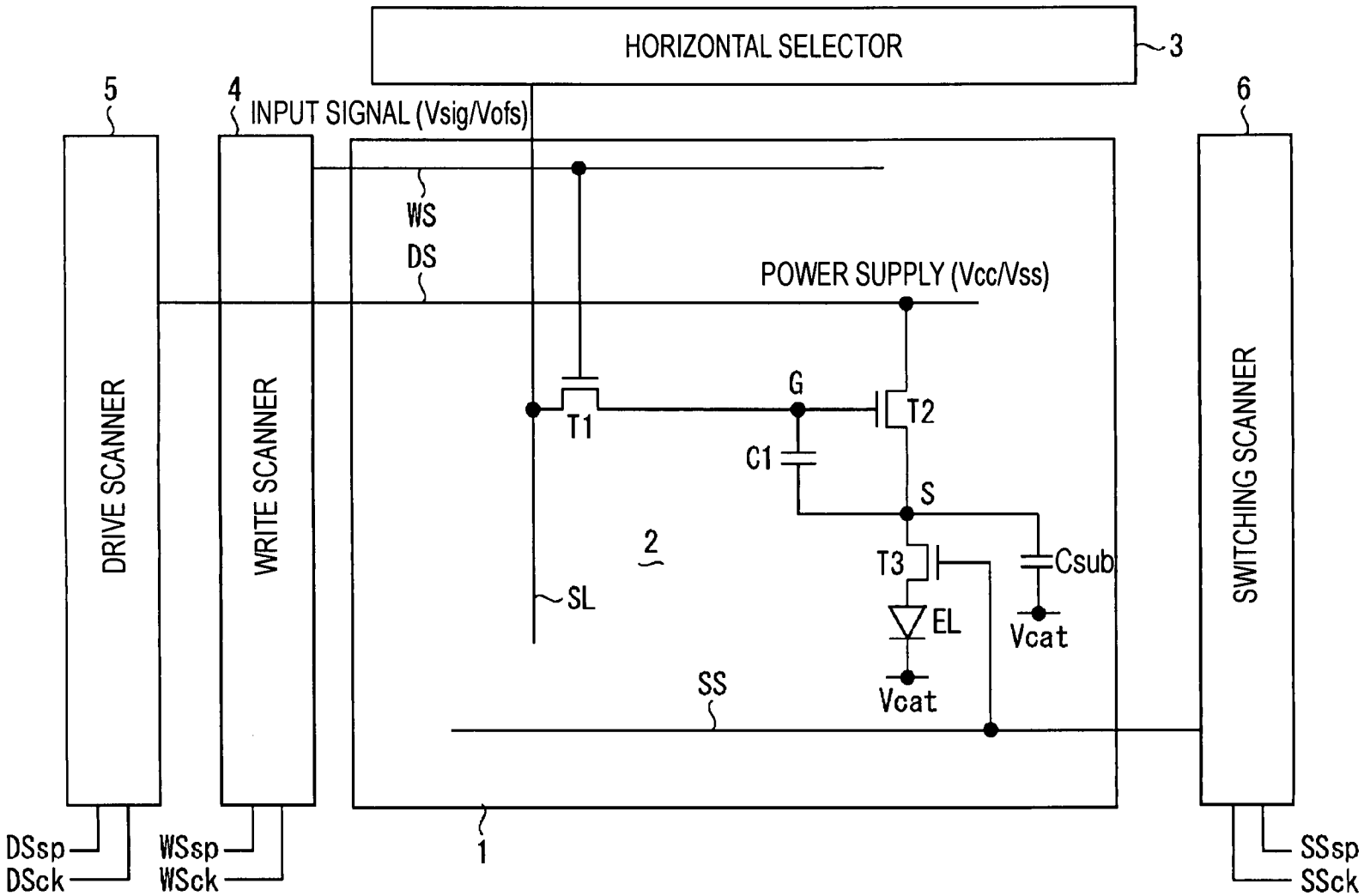
FIG. 12 is a circuit diagram showing an embodiment of a display apparatus according to the present invention.

FIG. 12 is a circuit diagram showing the configuration of a display apparatus according to the present invention. This display apparatus is obtained by improving the display apparatus according the preceding development shown in FIG. 2. For the sake of easier understanding, parts corresponding to the example of the preceding development are denoted by corresponding reference numerals. A different point is that a switching transistor T3 is connected between the source S of the driving transistor T2 (output node) and the anode of the light-emitting device EL. In addition, an auxiliary capacitor Csub is connected between the source S of the driving transistor T2 and a fixed potential. In this example, the fixed potential is set to the cathode potential Vcat. However, the present invention is not limited to this. The auxiliary capacitor Csub is added in order to carry out a function instead of the equivalent capacitor Cel of the light-emitting device EL. Here, in order to perform on/off control of the switching transistor T3, a switching scanner 6 is added. The switching scanner 6 performs line-sequential scanning of scanning lines SS, and performs on/off control of the switching transistor T3. Similarly to other scanners, the switching scanner 6 is also constituted by shift registers. The switching scanner 6 operates in accordance with clock signals SSck that are supplied from the outside and sequentially transfers start pulses SSsp that are also supplied from the outside, so that the switching scanner 6 outputs control signals to scanning lines SS.

Here, the configuration of the display apparatus according to the present invention shown in FIG. 12 will be explained again. As shown in the figure, the pixel array unit 1 of this display apparatus includes scanning lines WS in rows, signal lines SL in columns, and pixels 2 arranged in a matrix in portions where the scanning lines WS and the signal lines SL intersect with each other. The pixels 2 each include at least the sampling transistor T1, the driving transistor T2 having the input node and the output node, the switching transistor T3, the holding capacitor C1, and the auxiliary capacitor Csub. In addition, the input node is the gate G of the driving transistor T2, and the output node is the source S of the driving transistor T2. The sampling transistor T1 is arranged between a signal line SL and the input node G, and is brought into conduction in accordance with a control signal supplied from a scanning line WS. The sampling transistor T1 writes to the holding capacitor C1 a video signal (Vsig/Vofs) supplied from the signal line SL. The driving transistor T2 outputs to the output node S a driving current in accordance with the signal potential Vsig of the video signal written to the holding capacitor C1. The holding capacitor C1 is arranged between the input node G and the output node S. The auxiliary capacitor Csub is connected between the output node S and a predetermined fixed potential Vcat. The switching transistor T3 is arranged between the output node S and the light-emitting device EL. In a predetermined light-emission period, the switching transistor T3 is in an on-state, and supplies the driving current to the light-emitting device EL to cause the light-emitting device EL to emit light at a brightness corresponding to the video signal. In contrast, in a non-light-emission period, the switching transistor T3 is turned off to disconnect the light-emitting device EL from the output node S, so that a potential generated at the output node S due to an operation of the pixel 2 performed in the non-light-emission period is prevented from being applied as a reverse-bias voltage to the light-emitting device EL of a diode type. With this configuration, the light-emitting device EL is prevented from being damaged, and a black-spot defect does not occur in the pixel 2.

Specifically, the gate G of the pixel transistor T2 is connected to the input node, the drain of the pixel transistor T2 is connected to a power supply line (power feed line) DS, and the source S of the pixel transistor T2 is connected to the output node. The anode of the light-emitting device EL is connected to the output node with the switching transistor T3 therebetween, and the cathode of the light-emitting device EL is connected to a ground line (Vcat). The auxiliary capacitor Csub is connected between the output node and the ground line Vcat. The pixel 2 in this display apparatus is provided with threshold-voltage correction means and mobility correction means. The threshold-voltage correction means is configured as functions of the horizontal selector 3, the write scanner 4, and the drive scanner 5 and operates in a non-light-emission period. In a state where a potential exceeding a reverse-bias voltage is applied to the output node S, a voltage corresponding to the threshold voltage Vth of the driving transistor T2 is held in the holding capacitor C1 between the input node G and the output node S. In addition, the mobility correction means is also configured as part of the functions of the write scanner 4, the drive scanner 5, and the horizontal selector 3 and operates when a video signal is being written in a non-light-emission period. In a state where a potential exceeding a reverse-bias voltage is applied to the output node S, a driving current is negatively fed back from the output node S to the holding capacitor C1. Thus, correction corresponding to the mobility μ of the driving transistor T2 is applied.

Figure 13:
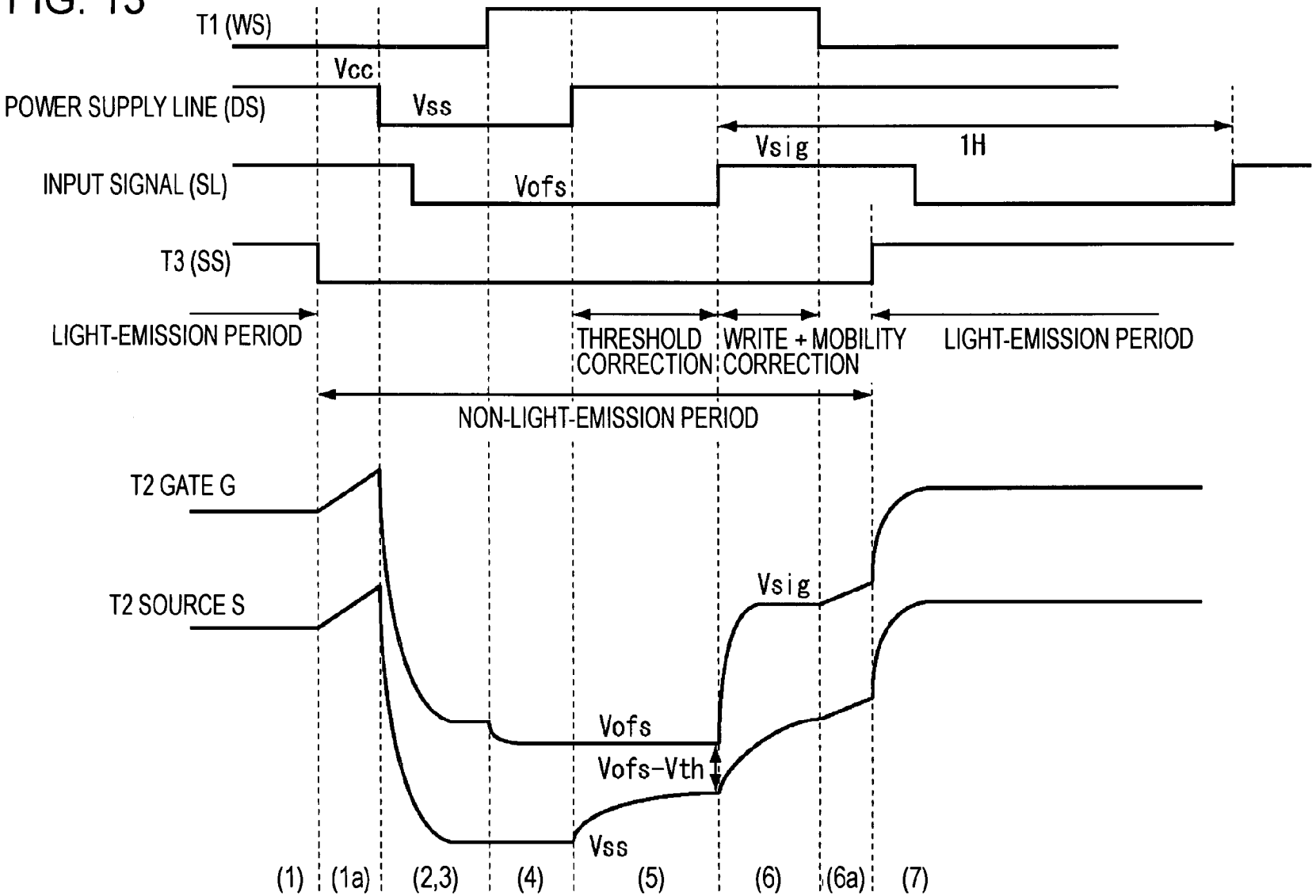
FIG. 13 is a timing chart provided for explaining operations of the display apparatus shown in FIG. 12.

FIG. 13 is a timing chart provided for explaining operations of the display apparatus shown in FIG. 12. For the sake of easier understanding, the same notation as in the timing chart shown in FIG. 3 provided for explaining the operations of the display apparatus according to the preceding development is adopted. However, in the display apparatus according to the present invention, additional scanning lines SS exist, as well as the scanning lines WS, the power supply lines DS, and the signal lines SL. Thus, the timing chart 13 also represents a change in the potential of an additional scanning line SS, using the same time base for the scanning line WS. As shown in the timing chart, a change in the potential of the scanning line SS performs on/off control of the switching transistor T3.

In the case that the scanning line SS is at high level, the switching transistor T3 is in the on-state. In the case that the scanning line SS is at low level, the switching transistor T3 is in the off-state.

In the timing chart, after the light-emission period (1) for the previous field ends, the non-light-emission periods (1*a*) to (6*a*) for the corresponding field start. Then, the light-emission period (7) for the corresponding field starts. As shown in the figure, the source S of the driving transistor T2 (output node) is at a potential level in the minus direction in the non-light-emission periods (1*a*) to (6*a*). In particular, in the preparation period (4) before a threshold-voltage correction operation, the potential exhibits the lowest level Vss. In contrast, the switching transistor T3 is in the off-state just in the non-light-emission periods, and the light-emitting device EL is disconnected from the output node of the driving transistor T2. Thus, a voltage at a minus level is not applied from the output node to the light-emitting device EL in the non-light-emission periods, thus not entering the reverse-biased state. Accordingly, unexpected damage in the light-emitting device EL can be avoided.

Figure 14:
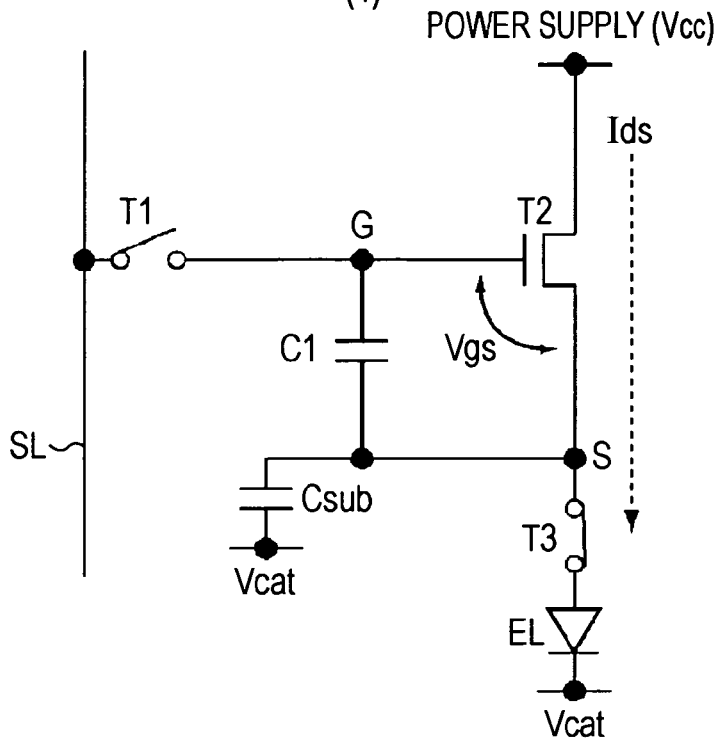
FIG. 14 is a schematic diagram also provided for explaining an operation of the display apparatus according to the present invention shown in FIG. 12.

The operations of the pixel circuit shown in FIG. 12 will be explained in detail with reference to FIGS. 14 to 19. First, as shown in FIG. 14, in the light-emission period (1) for the previous field, the power supply line is at Vcc and only the sampling transistor T1 is in the off-state. At this time, since the driving transistor T2 is set so as to operate in the saturation region, the driving current Ids flowing to the light-emitting device EL exhibits a value indicated by the above-described characteristic equation in accordance with the voltage Vgs between the gate G and the source S of the driving transistor T2.

Figure 15:
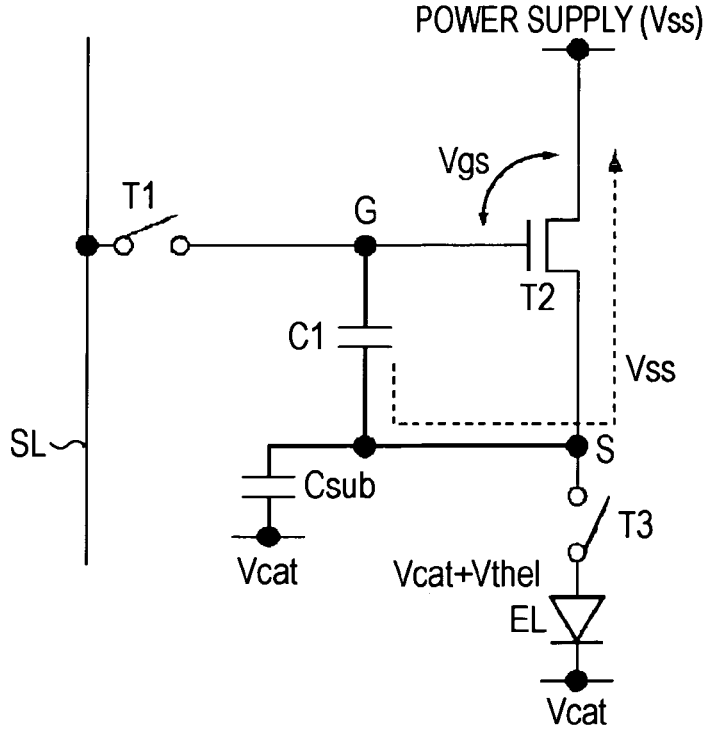
FIG. 15 is a schematic diagram also provided for explaining an operation.

Then, the non-light-emission periods for the corresponding field start. First, as shown in FIG. 15, in the initial period (1*a*), the switching transistor T3 is turned off. In the subsequent period (2), the power supply line (power feed line) is set to Vss. Since the switching transistor T3 is turned off, power feed to the light-emitting device EL is interrupted, and the anode voltage of the light-emitting device EL exhibits substantially the threshold voltage Vthel of the light-emitting device EL. In addition, since the power supply line is dropped from Vcc to Vss, Vss is charged in the source S of the driving transistor T2.

Figure 16:
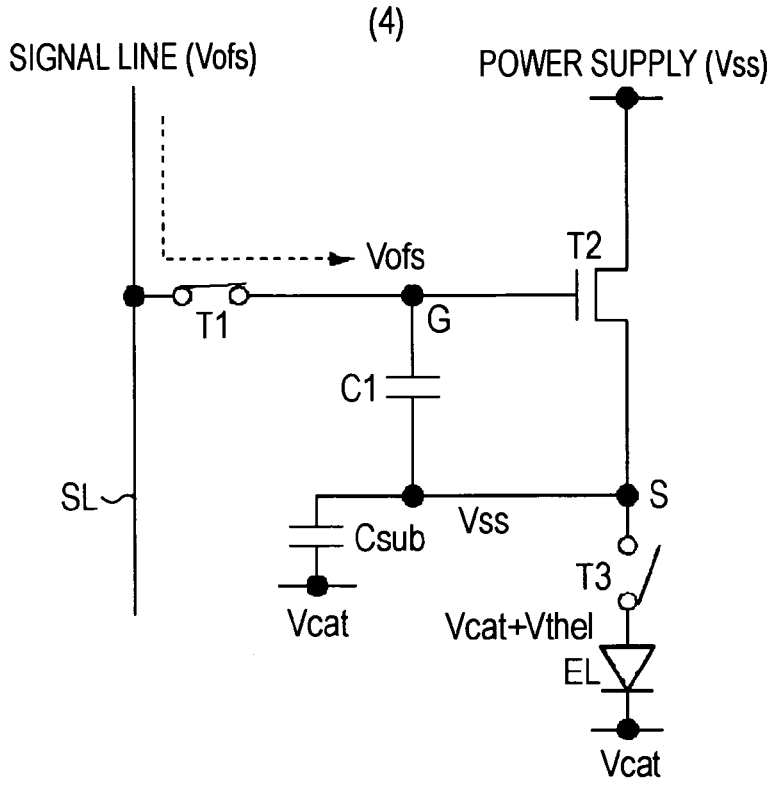
FIG. 16 is a schematic diagram also provided for explaining an operation.

Then, after the potential of the signal line SL is switched from Vsig to Vofs in the period (3), in the preparation period (4), as shown in FIG. 16, the sampling transistor T1 is turned on and the potential of the gate G of the driving transistor T2 is set to Vofs. In this preparation period (4), the voltage Vgs between the gate G and the source S of the driving transistor T2 exhibits a value, Vofs−Vss. If Vgs=Vofs−Vss is smaller than the threshold voltage Vth of the driving transistor T2, the subsequent threshold-voltage correction operation cannot be performed. Thus, in this preparation period (4), it is necessary to set Vgs=Vofs−Vss>Vth. In order to satisfy this condition, Vss is set to a very low potential.

Figure 17:
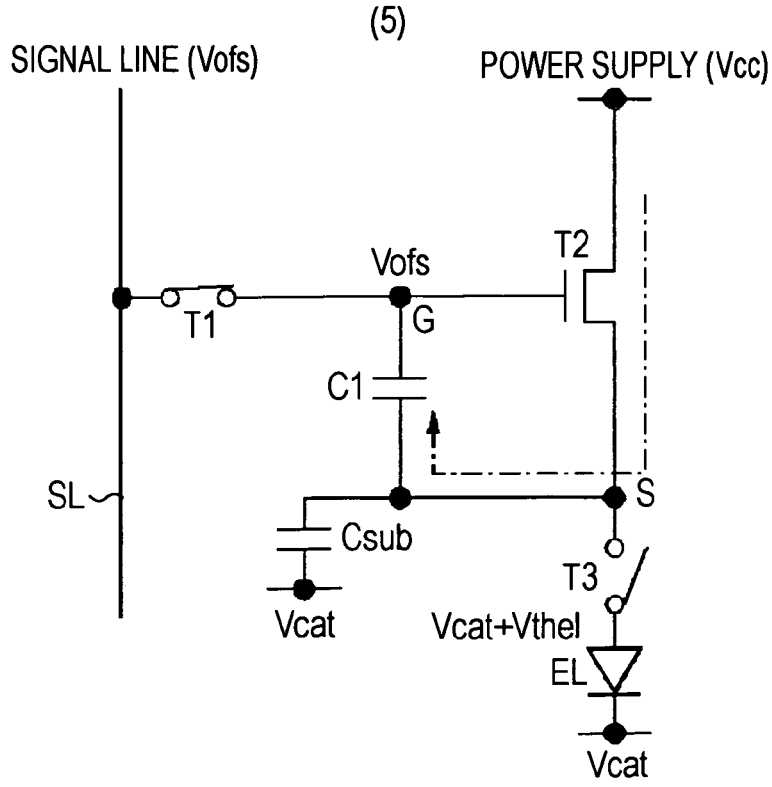
FIG. 17 is a schematic diagram also provided for explaining an operation.

Then, as shown in FIG. 17, the threshold-voltage correction period (5) starts, and the power feed line (power supply line) DS is returned to Vcc again. Since the power supply voltage is set to Vcc, a current flows in the driving transistor T2, as shown in the figure. This current is used for charging the holding capacitor C1 and the auxiliary capacitor Csub. In the display apparatus according to the preceding development, the holding capacitor C1 and the equivalent capacitor Cel of the light-emitting device EL are charged in the mobility correction operation. In the present invention, since the light-emitting device EL is disconnected from the source S due to the switching transistor T3, the auxiliary capacitor Csub is added to the source S, instead of the equivalent capacitor Cel. In the charging process for C1 and Csub, the potential of the source S of the driving transistor T2 increases with time. After a predetermined period has passed, the voltage Vgs between the gate G and the source S of the driving transistor T2 exhibits a value corresponding to Vth. That is, in this time, the potential of the source S of the driving transistor T2 reaches Vofs−Vth.

Figure 18:
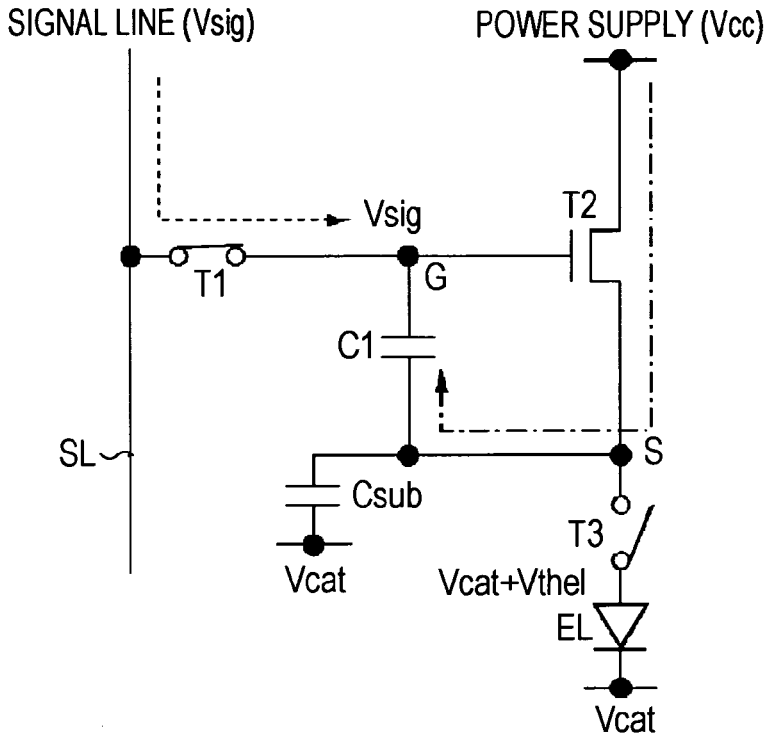
FIG. 18 is a schematic diagram also provided for explaining an operation.

Then, as shown in FIG. 18, the write period (6) starts. In a state where the sampling transistor T1 is turned on, the potential of the signal line SL is set to Vsig. Here, the signal potential Vsig exhibits a voltage corresponding to the gray-scale level of the brightness of the light-emitting device. Since the sampling transistor T1 is turned on, the potential of the gate G of the driving transistor T2 is Vsig. However, since the current flows from the power supply Vcc to the driving transistor T2, the potential of the source S of the driving transistor T2 also increases with time. Here, since the threshold-voltage correction operation of the driving transistor T2 has already been completed, the current flowing from the driving transistor T2 reflects the mobility μ. More specifically, in the case that the driving transistor has a large mobility μ, the amount of current at this time is large, and the increase in the source S is fast. In contrast, in the case that the driving transistor has a small mobility μ, the amount of current is small, and the potential increase in the source S is slow. Thus, Vgs of the driving transistor T2 becomes small due to reflection of the mobility μ. At a point in time when the correction period (6) ends, Vgs is a value that is completely corrected with the mobility μ.

Figure 19:
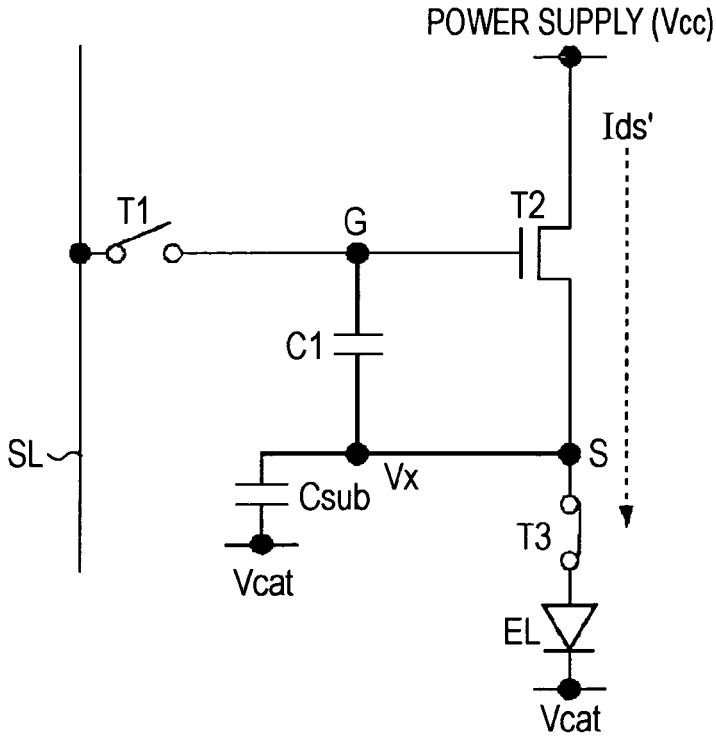
FIG. 19 is a schematic diagram also provided for explaining an operation.

After the switching transistor T3 is turned on in the period (6*a*), which corresponds to the last period of the non-light-emission periods, the light-emission period (7) for the corresponding field starts, as shown in FIG. 19. That is, the switching transistor T1 is turned off to stop writing, and the switching transistor T3 is turned on to cause the light-emitting device EL to emit light. Since the voltage Vgs between the gate G and the source S of the driving transistor T2 is constant, the driving transistor T2 causes a constant current Ids' to flow to the light-emitting device EL. The anode potential of the light-emitting device EL increases, and at a point in time when the anode potential of the light-emitting device EL reaches a voltage Vx, a forward-biased state starts and the light-emitting device EL emits light. Also in this pixel circuit, in a case where the light-emitting device EL emits light for a long time, the current/voltage characteristics of the light-emitting device EL change. Thus, the potential of the output node S also changes. However, since Vgs of the driving transistor T2 is always maintained constant due to a bootstrap operation even if the potential of the output node changes, the current Ids' flowing to the light-emitting device EL does not change. Thus, even if the current/voltage characteristics of the light-emitting device are deteriorated, a constant driving current always flows and the brightness of the light-emitting device EL does not change.

As is clear from the above description, in the display apparatus according to the present invention, a reverse bias is not applied to a light-emitting device EL in a non-light-emission period. Only a voltage corresponding to the threshold voltage Vthel of the light-emitting device EL is applied to the light-emitting device EL in the non-light-emission period. As stated above, in the present invention, since only a voltage that is smaller than the reverse bias amount is applied to the light-emitting device EL in the non-light-emission period, the light-emitting device EL can be prevented from being damaged and occurrence of a black-spot defect in a pixel can be prevented, thus achieving high yield.

Figure 20:
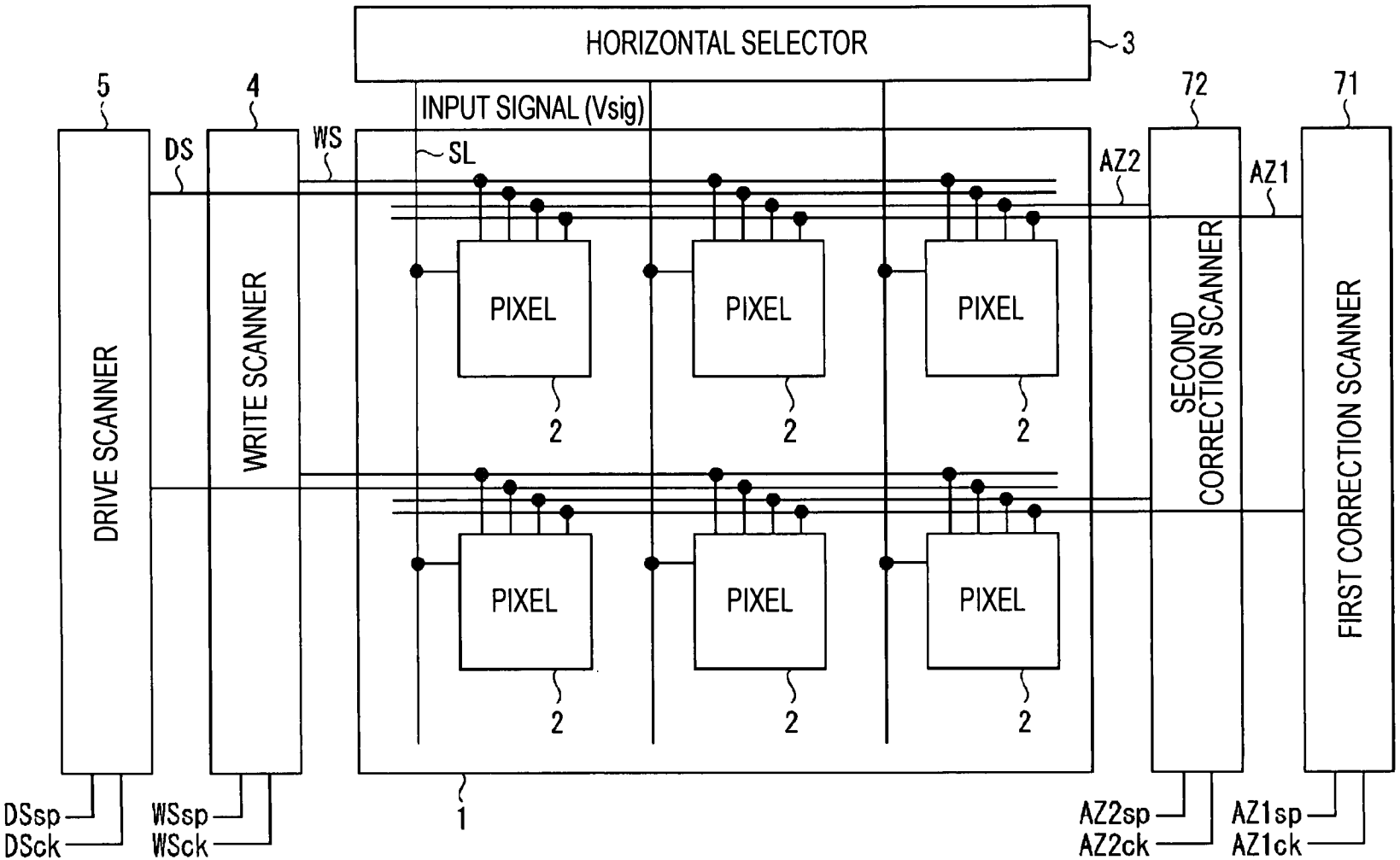
FIG. 20 is a block diagram showing another example of a display apparatus according to preceding development.

FIG. 20 is a block diagram showing a display apparatus according to different preceding development, on which the present invention is based. As shown in the figure, this display apparatus is basically constituted by the pixel array unit 1, scanner units, and a signal unit. The scanner units and the signal unit constitute driving units. The pixel array unit 1 includes scanning lines WS, DS, AZ1, and AZ2 arranged in rows, signal lines SL arranged in columns, and pixel circuits 2 arranged in a matrix and connected to the scanning lines WS, DS, AZ1, and AZ2 and the signal line SL. The signal unit includes the horizontal selector 3 and supplies video signals to the signal lines SL. The scanner units include the write scanner 4, the drive scanner 5, a first correction scanner 71, and a second correction scanner 72. The write scanner 4, the drive scanner 5, the first correction scanner 71, and the second correction scanner 72 supply control signals to the scanning lines WS, DS, AZ1, and AZ2, respectively, to sequentially scan the pixel circuits for individual rows, and perform predetermined threshold-voltage correction operation, signal writing operation, light emission operation, and the like.

The write scanner 4 includes shift registers. The write scanner 4 operates in accordance with clock signals WSck that are supplied from the outside and sequentially transfers start pulses WSsp that are also supplied from the outside, so that the write scanner 4 outputs predetermined control signals to corresponding scanning lines WS in a line-sequential manner. Similarly, the drive scanner 5 also includes shift registers. The drive scanner 5 operates in accordance with clock signals DSck and start pulses DSsp, and outputs predetermined control signals to corresponding scanning lines DS. Similarly, the first correction scanner 71 also operates in response to reception of clock signals AZ1*ck* and start pulses AZ1*sp*. The second correction scanner 72 also receives clock signals AZ2*ck* and AZ2*sp* that are supplied from the outside, and outputs predetermined control signals to corresponding scanning lines AZ2.

Figure 21:
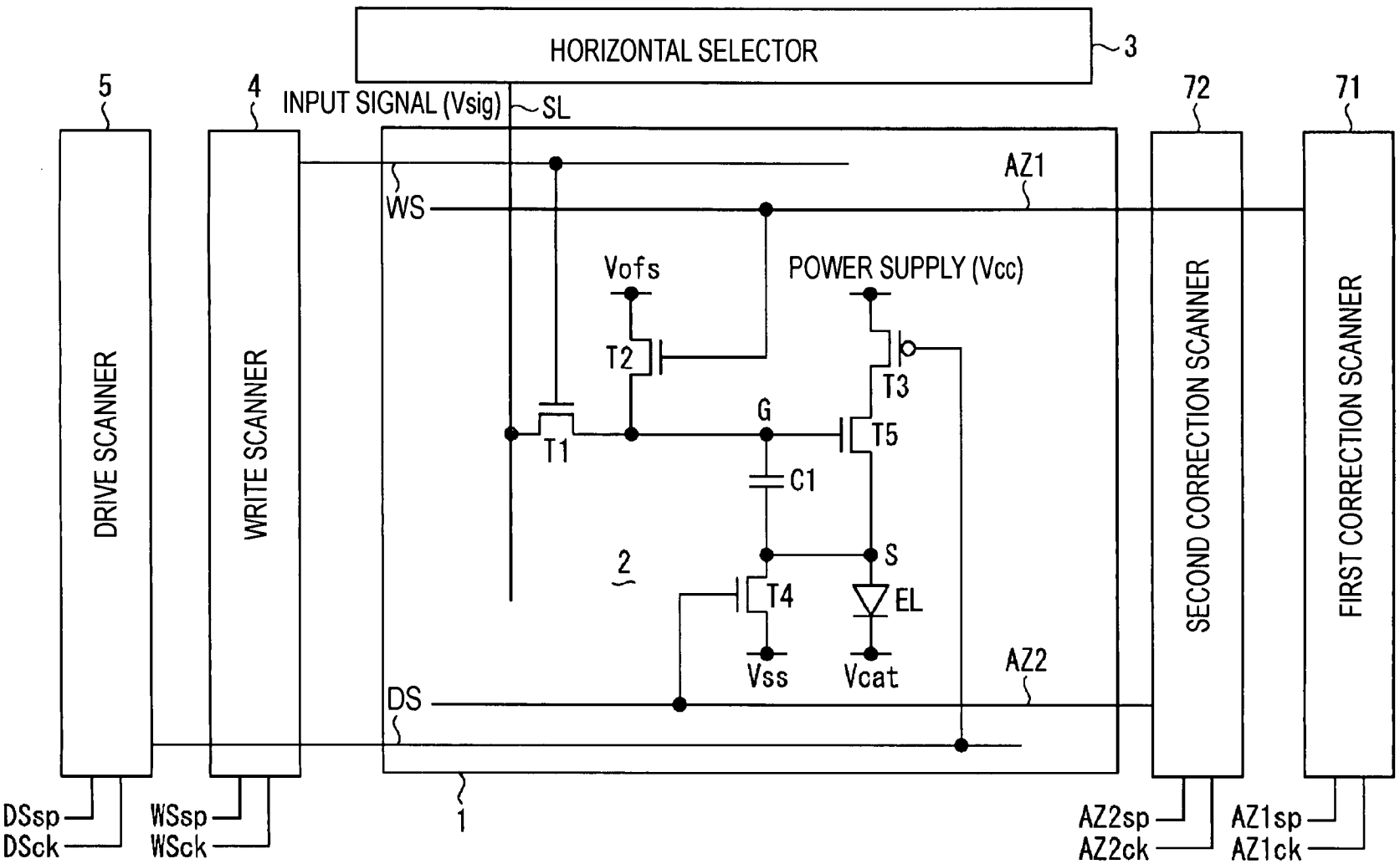
FIG. 21 is a circuit diagram showing the configuration of a pixel incorporated in the display apparatus shown in FIG. 20.

FIG. 21 is a circuit diagram showing the configuration of a pixel incorporated in the display apparatus according to the preceding development shown in FIG. 20. As shown in the figure, the pixel circuits 2 each include the sampling transistor T1, three switching transistors T2, T3, and T4, a driving transistor T5, the holding capacitor C1, and the light-emitting device EL. The sampling transistor T1 is brought into conduction in accordance with a control signal supplied from a scanning line WS in a predetermined sampling period (video-signal write period), and samples a signal potential Vsig of a video signal supplied from a signal line SL in the holding capacitor C1. In accordance with the signal potential Vsig of the sampled video signal, the holding capacitor C1 applies an input voltage Vgs to the gate G of the driving transistor T5. The driving transistor T5 supplies an output current Ids, which corresponds to the input voltage Vgs, to the light-emitting device EL. The light-emitting device EL emits light at a brightness corresponding to the signal potential Vsig of the video potential in accordance with the output current Ids supplied from the driving transistor T5 in a predetermined light-emission period. In addition, the anode of the light-emitting device EL is connected to the source S of the driving transistor T5, whereas the cathode is connected to a predetermined ground potential (cathode potential) Vcat. In this specification, the source S of the driving transistor 5 may be referred to as a connection node.

The switching transistor T2 is brought into conduction in accordance with a control signal that is supplied from a scanning line AZ1 prior to the sampling period, and sets the gate G of the driving transistor T5 to a predetermined potential Vofs. The switching transistor T4 is brought into conduction in accordance with a control signal that is supplied from a scanning line AZ2 prior to the sampling period (write period), and sets the source S of the driving transistor T5 (output node) to a predetermined potential Vss. Similarly, the switching transistor T3 is brought into conduction in accordance with a control signal that is supplied from a scanning line DS prior to the write period, and connects the driving transistor T5 to the power supply potential Vcc. Thus, a voltage corresponding to the threshold voltage Vth of the driving transistor T5 is held in the holding capacitor C1, so that the influence of the threshold voltage Vth is corrected. Consequently, according to this example, the switching transistors T2, T3, and T4 constitute threshold-voltage correction means. In addition, the sampling transistor T1 and the switching transistor T3 cooperate to constitute mobility correction means. In part of the above-described write period, the output current Ids is negatively fed back to the holding capacitor C1. Thus, correction corresponding to the mobility μ of the driving transistor T5 is applied. Moreover, the switching transistor T3 is brought into conduction in accordance with a control signal that is supplied from the scanning line Ds again in a light-emission period, and connects the driving transistor T5 to the power supply potential Vcc to cause the output current Ids to flow to the light-emitting device EL.

As is clear from the above description, this pixel circuit 2 is constituted by the five transistors T1 to T5, the one holding capacitor C1, and the one light-emitting device EL. The transistors T1, T2, T4, and T5 are N-channel-type polysilicon TFTs. Only the transistor T3 is a P-channel-type polysilicon TFT. However, the present invention is not limited to this. N-channel-type TFTs and P-channel-type TFTs may be mixed in an appropriate manner. The light-emitting device EL is of a diode type provided with the anode and the cathode. For example, the light-emitting device EL is formed to be an organic EL device. The organic EL device switches between a forward-biased state and a reverse-biased state in accordance with the potential of the anode. In addition, the organic EL device emits light in accordance with an output current in the forward-biased state, whereas the organic EL device is set in the reverse-biased state when the pixel circuit performs the threshold-voltage correction operation and the mobility correction operation. However, in a case where the period of time in the reverse-biased state is too long or the reverse-bias voltage is too large, the organic EL device may be damaged. In addition, the present invention is not limited to an organic EL device. The light-emitting device includes all the devices that generally emit light by current driving.

Figure 22:
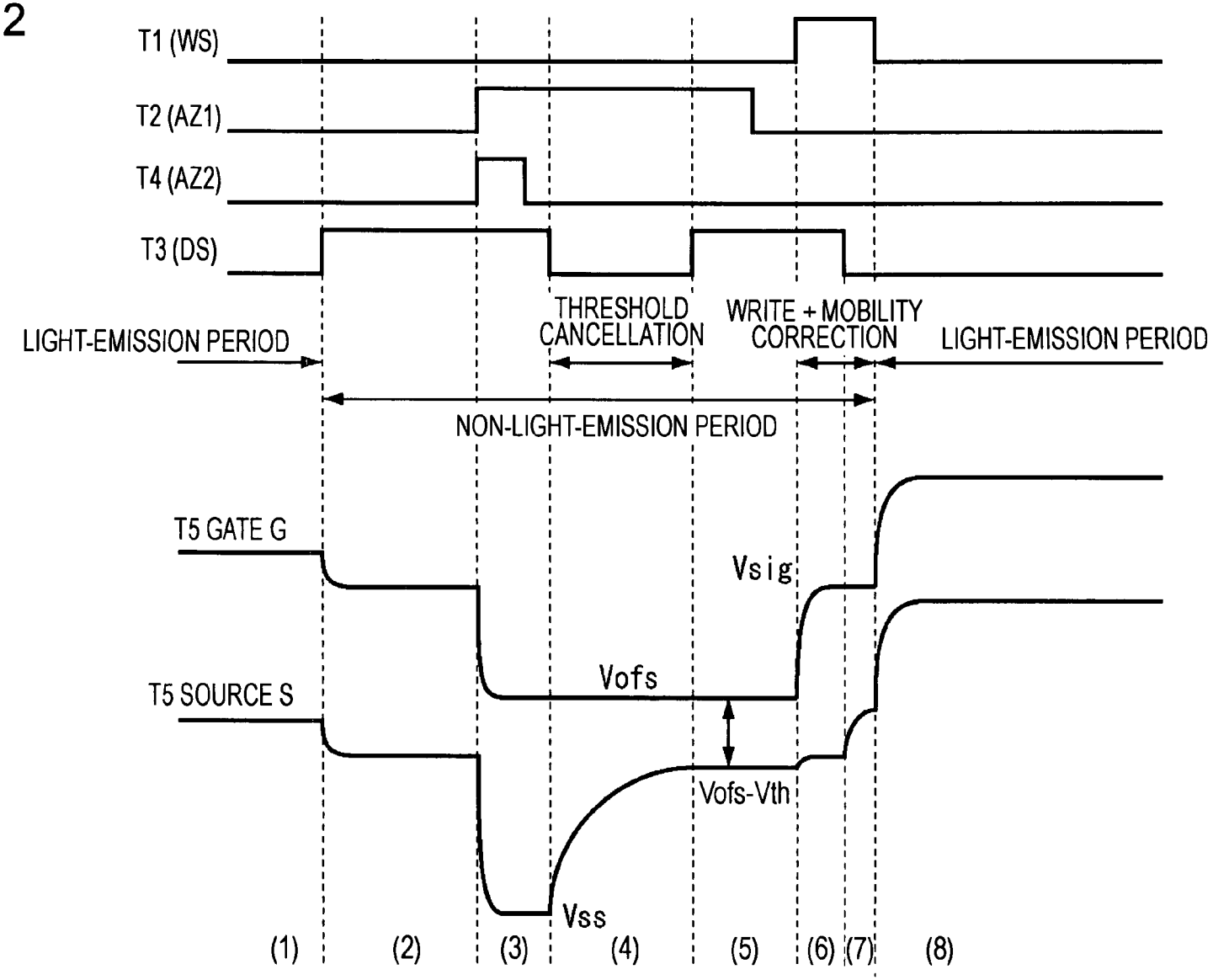
FIG. 22 is a timing chart provided for explaining operations of the pixel shown in FIG. 21.

FIG. 22 is a timing chart provided for explaining operations of the pixel shown in FIG. 21. In this timing chart, the waveforms of control signals to be applied to respective scanning lines WS, AZ1, AZ2, and DS are represented along the time base. Since the transistors T1, T2, and T4 are of the N-channel type, the transistors T1, T2, and T4 are turned on when respective scanning lines WS, AZ1, and AZ2 are at high level and are turned off when the respective scanning lines WS, AZ1, and AZ2 are at low level. In contrast, since the transistor T3 is of the P-channel type, the transistor T3 is turned off when a scanning line DS is at high level and is turned on when the scanning line DS is at low level. Thus, this timing chart also represents the on/off state of each of the transistors T1, T2, T3, and T4. In addition, this timing chart represents potential changes at the gate G and the source S of the driving transistor T5 as well as the waveforms of the respective control signals WS, AZ1, AZ2, and DS. The voltage generated between the gate G and the source S is a gate voltage Vgs, which serves as an input voltage for the driving transistor T5.

As shown in the figure, the timing chart is divided into periods (1) to (8), for the sake of convenience. The first light-emission period (1) belongs to the previous field. After the light-emission period (1) ends, the next field starts. First, the preparation periods (2) and (3) for threshold-voltage correction exist. Subsequently, the threshold-voltage correction period (4) exists. After the adjustment period (5), the write periods (6) and (7) start. Here, the write periods (6) and (7) include the mobility correction period (7). Then, the light-emission period (8) for the present field starts. Here, in the light-emission periods (1) and (8), the source S of the driving transistor T5 (connection node) has a relatively high potential, and the light-emitting device EL enters a forward-biased state and emits light. In contrast, in the periods (2) to (7), which are non-light-emission periods, the source S of the driving transistor T5 has a relatively low potential. A reverse-biased state starts, and the light-emitting device EL is in a non-light-emission state. In particular, in the preparation period (3), the potential of the source S drops deeply and a strong reverse-biased state starts.

As is clear from the timing chart shown in FIG. 22, also in the display apparatus according to the preceding development, in the non-light-emission periods (2) to (7), a significant minus bias is applied to the source S of the driving transistor T5. Since such a minus bias is directly applied to the light-emitting device EL, the light-emitting device EL is put in the reverse-biased state in the non-light-emission periods, which may damage the light-emitting device EL.

Figure 23:
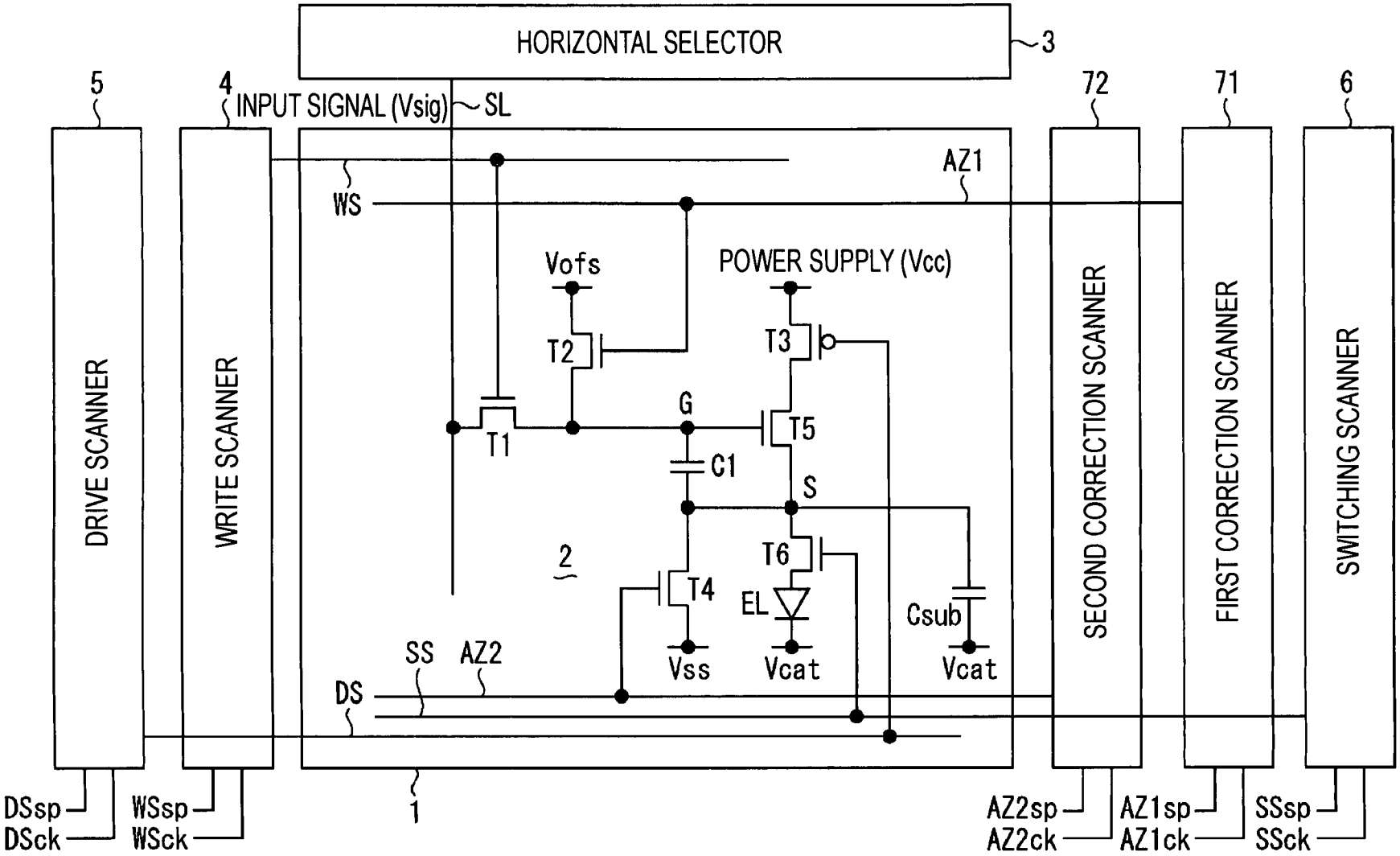
FIG. 23 is a circuit diagram showing another embodiment of a display apparatus according to the present invention.
Figure 24:
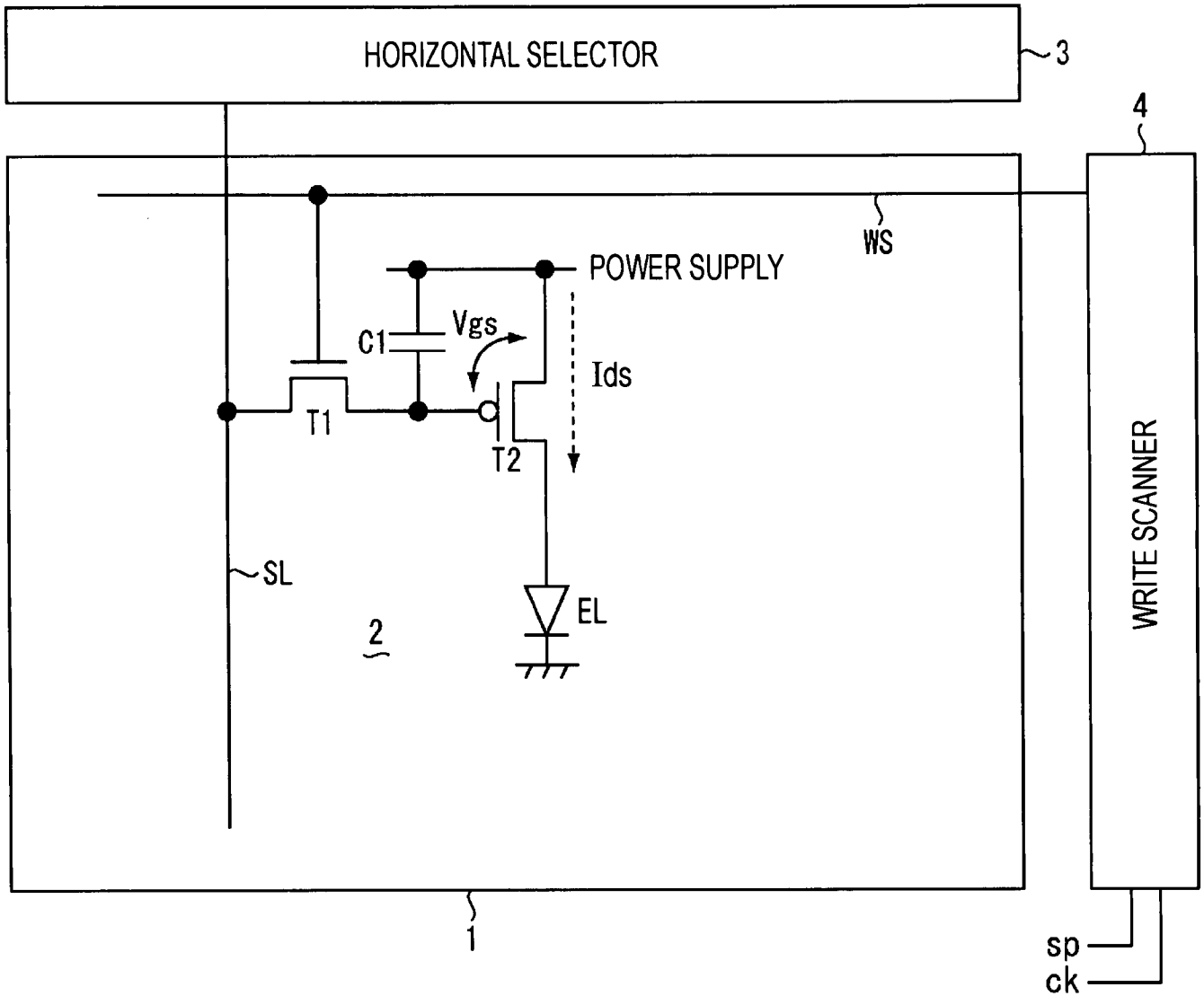
FIG. 24 is a circuit diagram showing an example of a known display apparatus.
Figure 25:
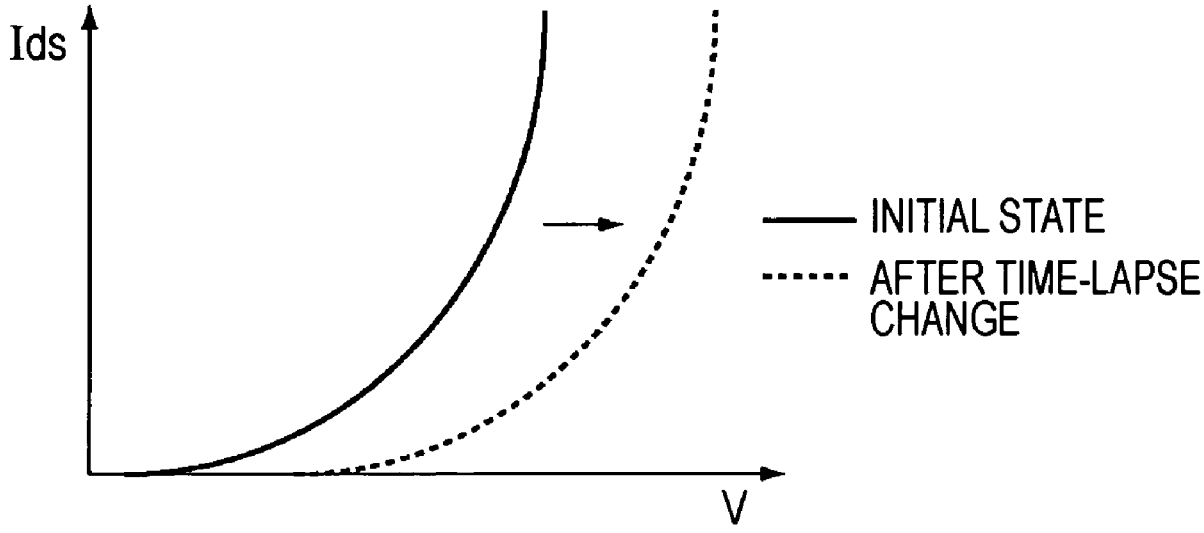
FIG. 25 is a graph provided for explaining operations of the known display apparatus shown in FIG. 24.
Figure 26:
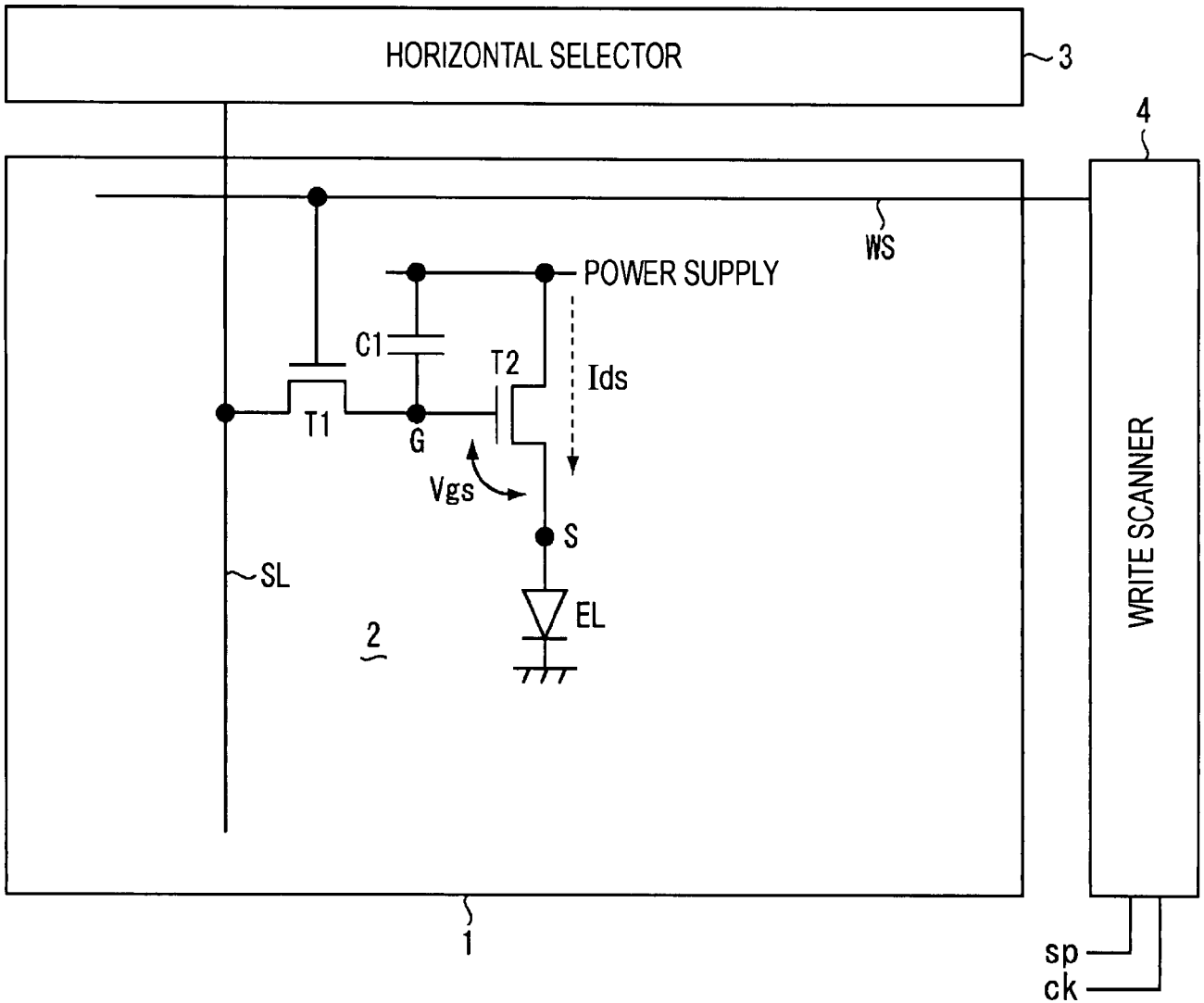
FIG. 26 is a circuit diagram showing another example of a known display apparatus.

FIG. 23 is a circuit diagram showing another embodiment of the display apparatus according to the present invention. This embodiment is obtained by improving the display apparatus according to the preceding development shown in FIG. 21. For the sake of easier understanding, corresponding parts are denoted by corresponding reference numerals. A different point is that a switching transistor T6 is inserted between the output node S of the driving transistor T5 and the anode of the light-emitting device EL. In addition, the switching scanner 6 is connected to the gate of the switching transistor T6 with a scanning line SS therebetween, and the switching transistor T6 is turned off in the non-light-emission periods. Thus, in the non-light-emission periods, since the light-emitting device EL is disconnected from the output node S of the driving transistor T5, the reverse-biased state does not start. In addition, the auxiliary capacitor Csub is connected between the output node S and the fixed potential Vcat.

Figure 27:
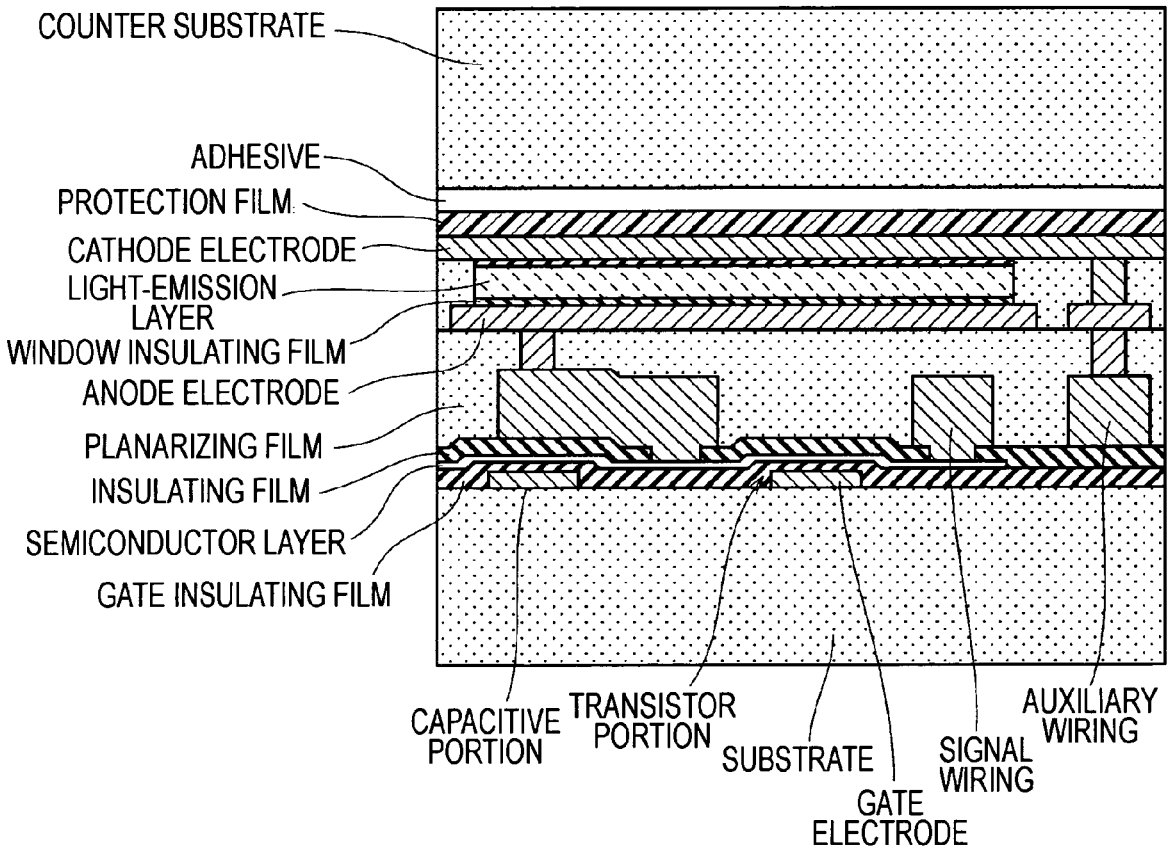
FIG. 27 is a sectional view showing the device configuration of a display apparatus according to the present invention.

The display apparatus according to the present invention has a thin-film device configuration as shown in FIG. 27. This figure represents a schematic sectional configuration of a pixel formed on an insulating substrate. As shown in the figure, the pixel includes a transistor portion including a plurality of thin-film transistors (in the figure, a single TFT is exemplified), a capacitive portion, such as a holding capacitor, and a light-emission portion, such as an organic EL device. The transistor portion and the capacitive portion are formed in accordance with a TFT process on the substrate, and the light-emission portion, such as the organic EL device, is stacked above the transistor portion and the capacitive portion. A transparent counter substrate is attached above the light-emission portion with an adhesive therebetween to form a flat panel.

Figure 28:
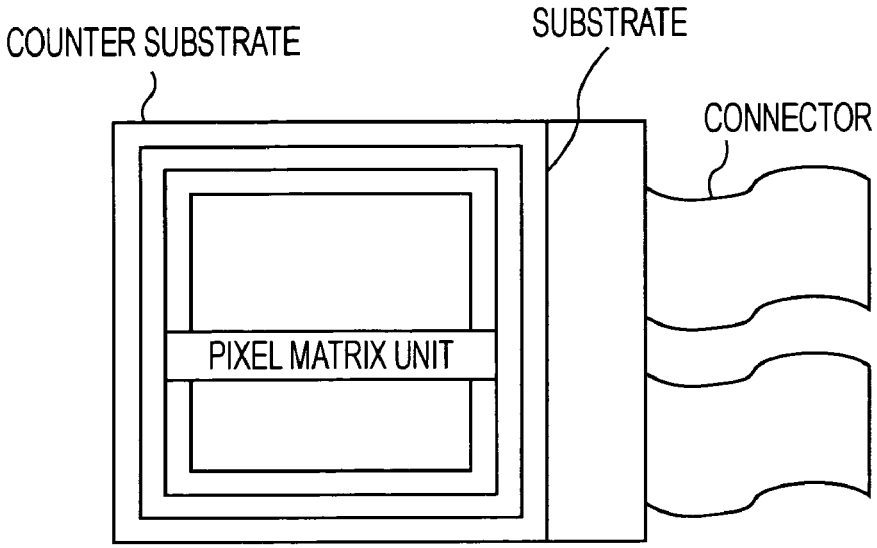
FIG. 28 is a plan view showing the module configuration of the display apparatus according to the present invention.

The display apparatus according to the present invention includes a flat-type display apparatus having a module configuration, as shown in FIG. 28. For example, on an insulating substrate, a pixel array unit in which pixels including organic EL devices, thin-film transistors, thin-film capacitors, and the like are integrated and formed in a matrix is provided. An adhesive is arranged to surround the pixel array unit (pixel matrix unit), and a counter substrate made of glass or the like is attached to form a display module. The transparent counter substrate may be provided with a color filter, a protection film, a light-shielding film, and the like according to need. In the display module, for example, an FPC (flexible print circuit) may be provided as a connector for inputting and outputting a signal and the like from the outside to the pixel array unit.

The above-described display apparatus according to the present invention can have a flat-panel shape and can be applied to a display of various electronic apparatuses, for example, electronic apparatuses in any fields, such as digital cameras, notebook-type personal computers, cellular phones, and video cameras, for displaying video signals input to the electronic apparatus or generated within the electronic apparatus as images or videos. An example of an electronic apparatus to which such a display apparatus is applied will be described below.

Figure 29:
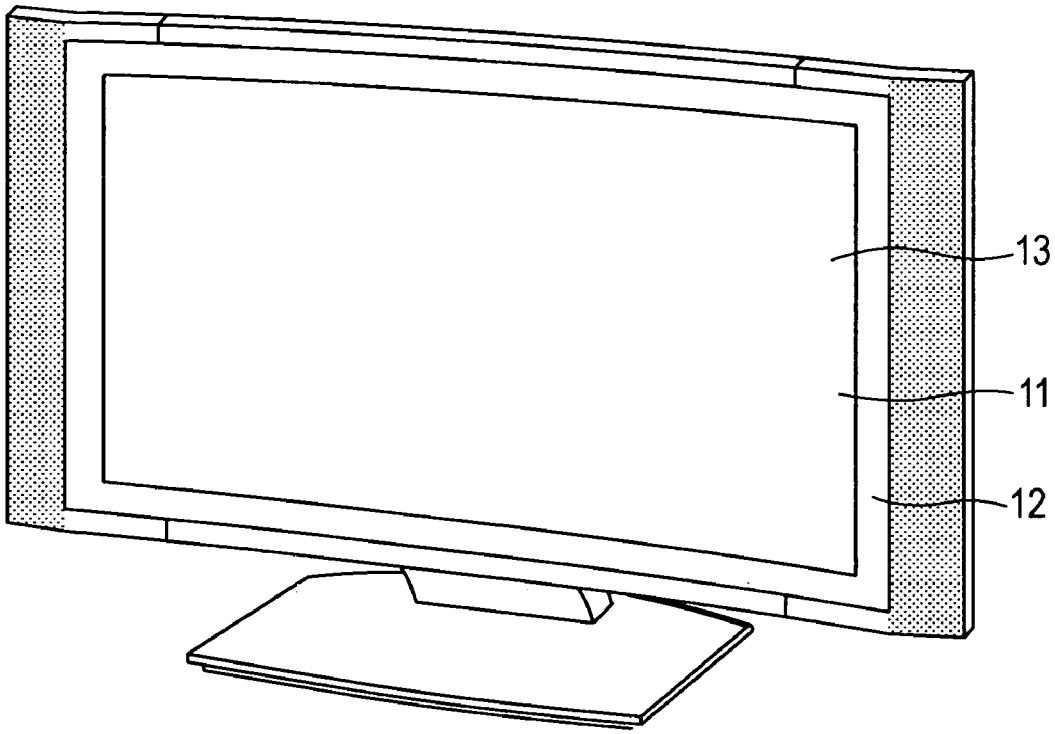
FIG. 29 is a perspective view showing a television set provided with the display apparatus according to the present invention.

FIG. 29 shows a television set to which the present invention is applied. The television set includes a video display screen 11 constituted by a front panel 12, filter glass 13, and the like and is manufactured by using the display apparatus according to the present invention as the video display screen 11 of the television set.

Figure 30:
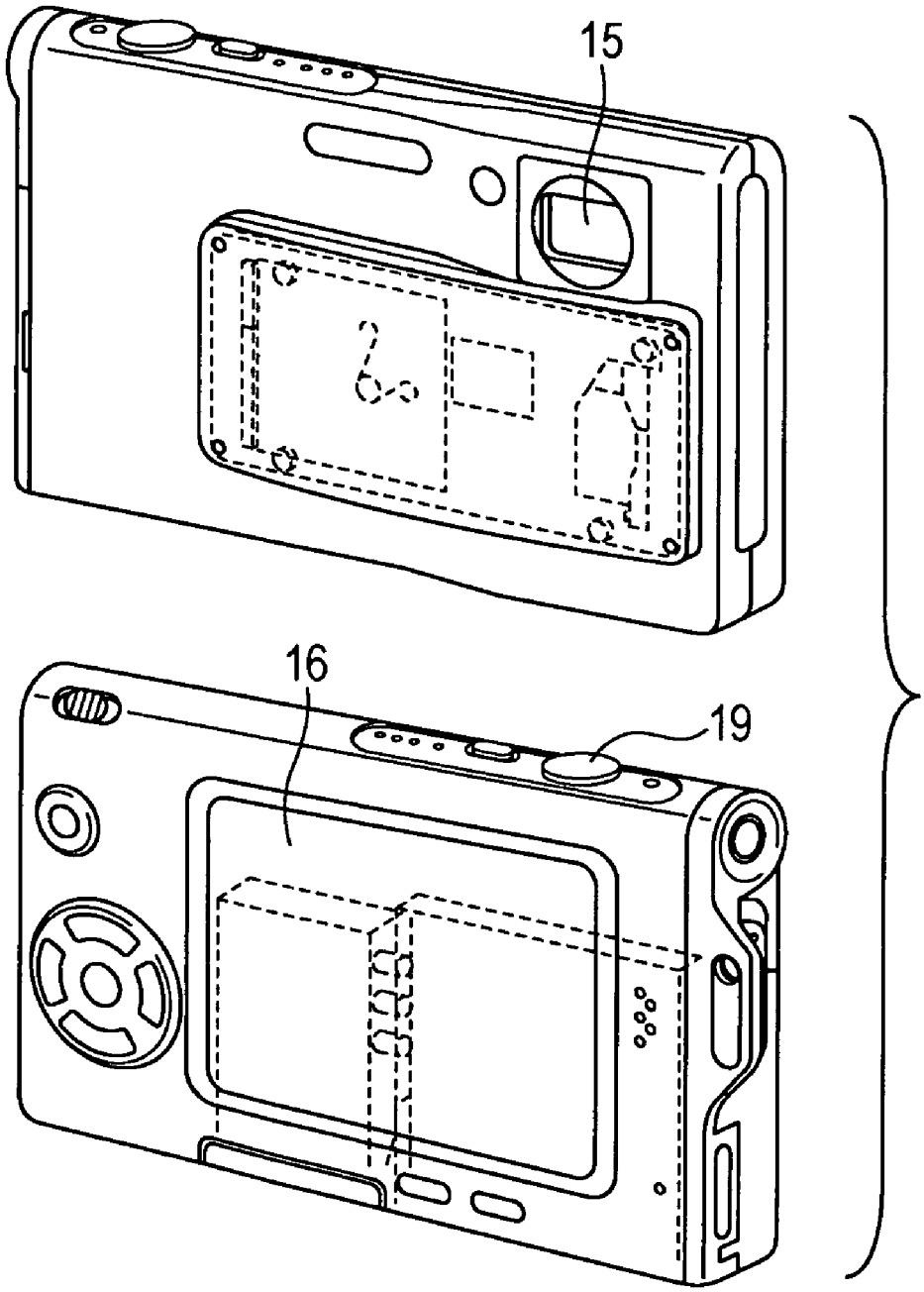
FIG. 30 includes perspective views showing a digital still camera provided with the display apparatus according to the present invention.

FIG. 30 shows a digital camera to which the present invention is applied. The upper portion of FIG. 30 is a front view and the lower portion of FIG. 30 is a back view. The digital camera includes an image-taking lens, a light-emission unit 15 for flash, a display unit 16, a control switch, a menu switch, a shutter 19, and the like and is manufactured by using the display apparatus according to the present invention as the display unit 16 of the digital camera.

Figure 31:
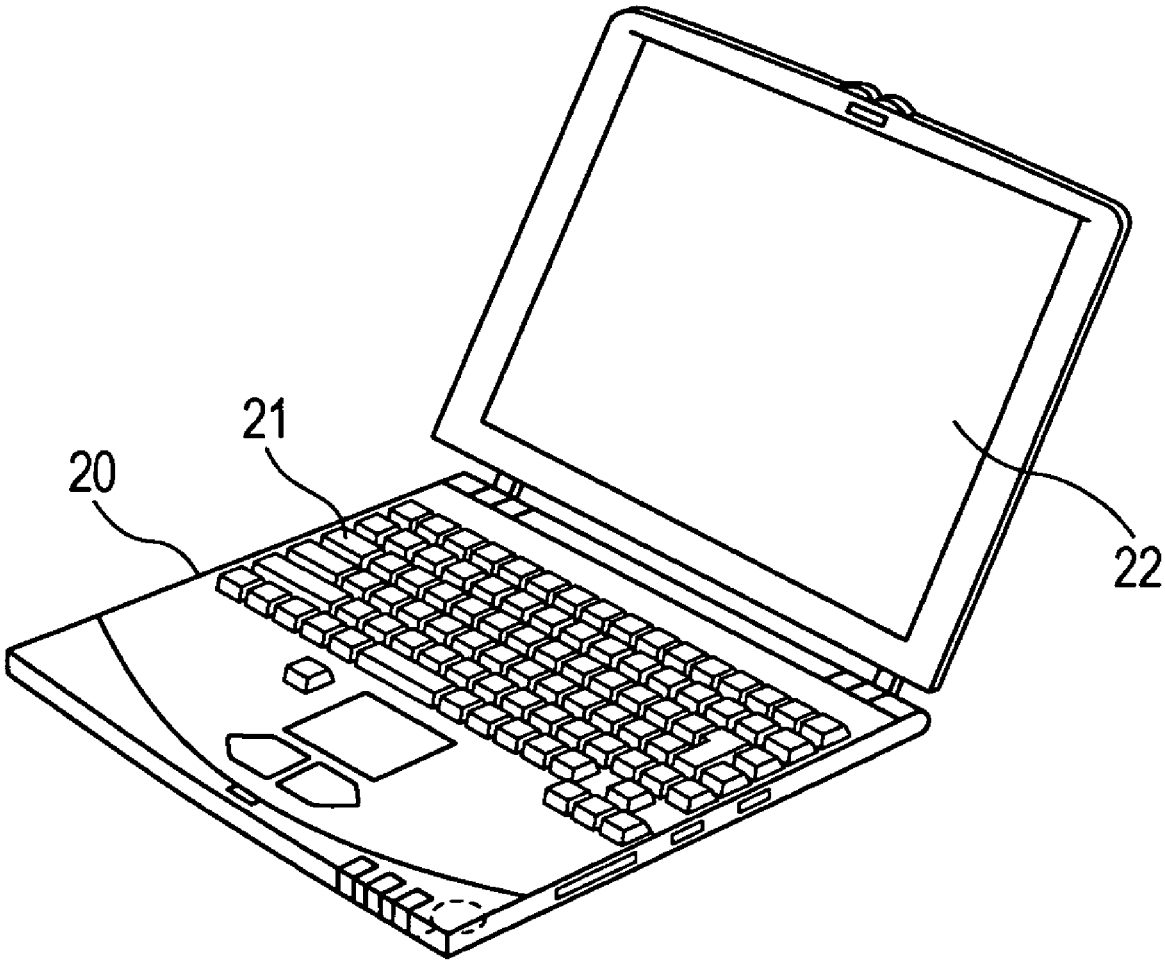
FIG. 31 is a perspective view showing a notebook-type personal computer provided with the display apparatus according to the present invention.

FIG. 31 shows a notebook-type personal computer to which the present invention is applied. A main body 20 includes a keyboard 21 to be operated when a character or the like is entered, and a main body cover includes a display unit 22 for displaying an image. The notebook-type personal computer is manufactured by using the display apparatus according to the present invention as the display unit 22 of the notebook-type personal computer.

Figure 32:
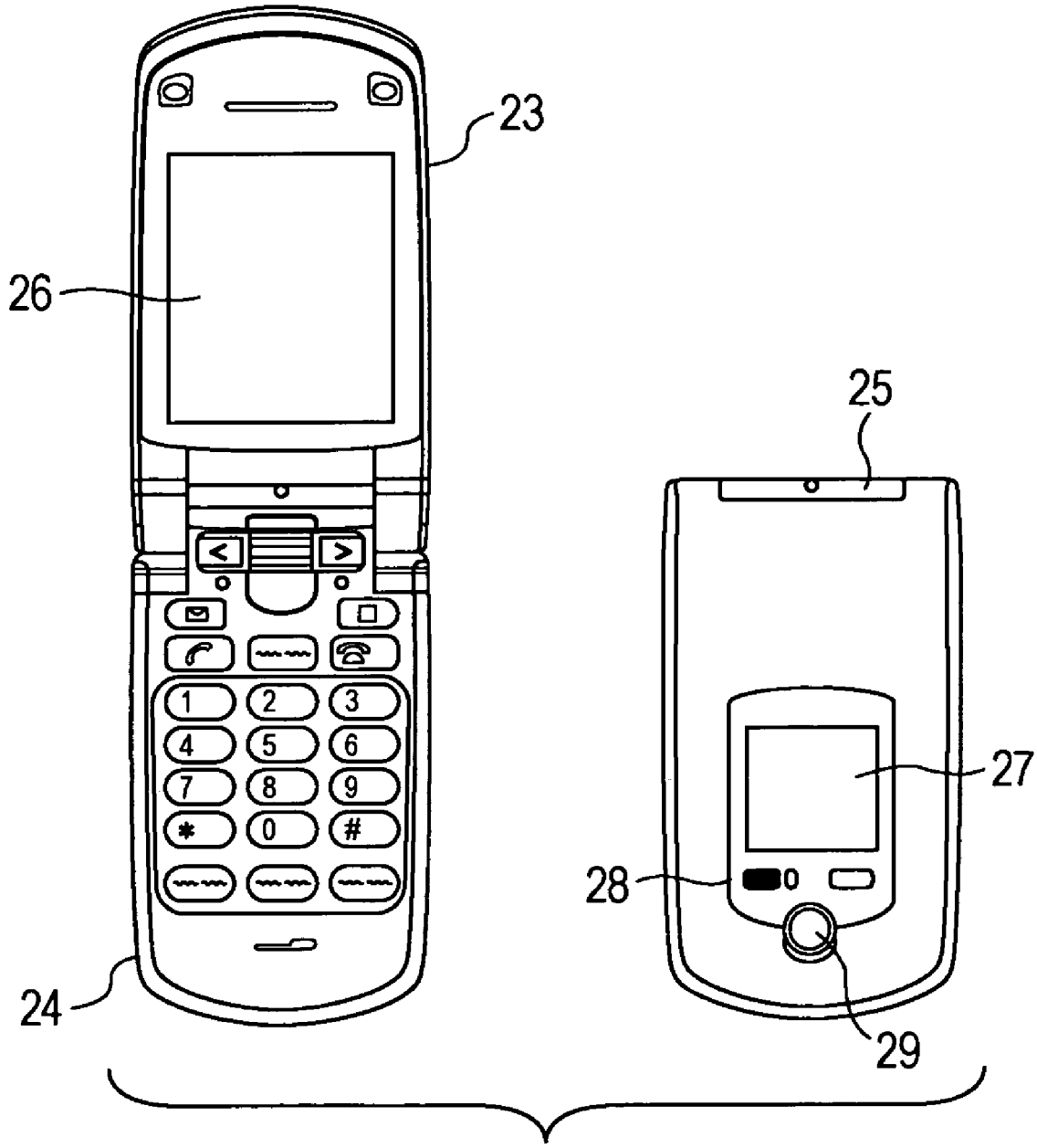
FIG. 32 includes schematic views showing a portable terminal apparatus provided with the display apparatus according to the present invention.

FIG. 32 shows a portable terminal apparatus to which the present invention is applied. The left portion of FIG. 32 represents a state where the portable terminal apparatus is opened and the right portion of FIG. 32 represents a state where the portable terminal apparatus is closed. The portable terminal apparatus includes an upper casing 23, a lower casing 24, a connection unit (here, a hinge unit) 25, a display 26, a sub-display 27, a picture light 28, a camera 29, and the like and is manufactured by using the display apparatus according to the present invention as the display or the sub-display 27 of the portable terminal apparatus.

Figure 33:
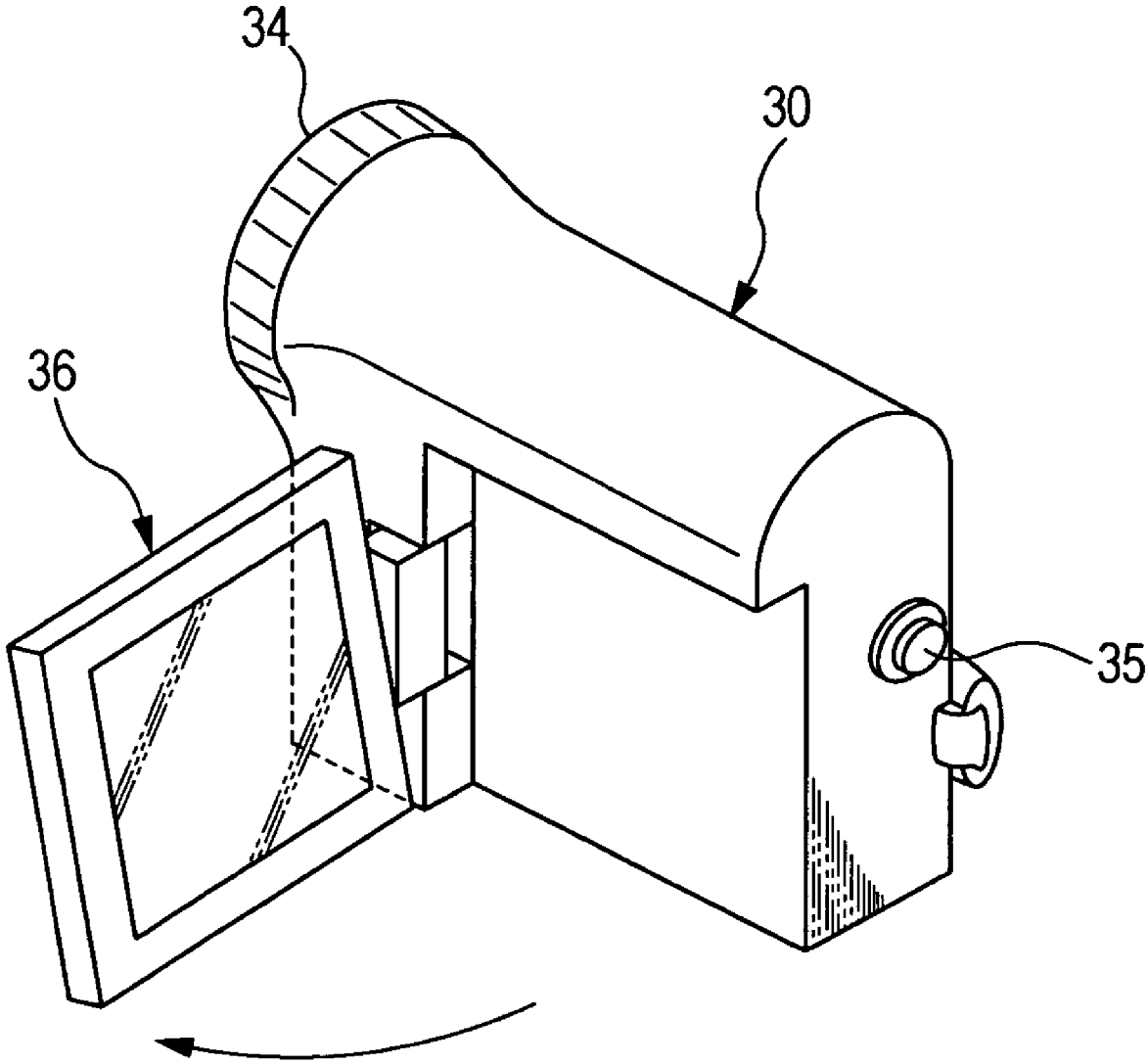
FIG. 33 is a perspective view showing a video camera provided with the display apparatus according to the present invention.

FIG. 33 shows a video camera to which the present invention is applied. The video camera includes a main body unit 30, an object-image taking lens 34 at a side when being directed front, a start/stop switch 35 for the case of taking an image, a monitor 36, and the like and is manufactured by using the display apparatus according to the present invention as the monitor 36 of the video camera.

The invention claimed is:

1. A display apparatus characterized by comprising scanning lines in rows, signal lines in columns, and pixels arranged in a matrix in portions where the scanning lines and the signal lines intersect with each other, wherein the pixels each include at least a sampling transistor, a driving transistor having an input node and an output node, a switching transistor, a light-emitting device, a holding capacitor, and an auxiliary capacitor, wherein the sampling transistor is arranged between the signal line and the input node, is brought into conduction in accordance with a control signal supplied from the scanning line, and writes to the holding capacitor a video signal supplied from the signal line, wherein the driving transistor outputs a driving current to the output node in accordance with a signal potential of the video signal written to the holding capacitor, wherein the holding capacitor is arranged between the input node and the output node, wherein the auxiliary capacitor is connected to the output node, and wherein the switching transistor is arranged between the output node and the light-emitting device, and in a predetermined light-emission period, the switching transistor is in an on-state and supplies the driving current to the light-emitting device to cause the light-emitting device to emit light at a brightness corresponding to the video signal, whereas in a non-light-emission period, the switching transistor is turned off to disconnect the light-emitting device from the output node, so that a potential generated at the output node due to an operation of the pixel performed in the non-light-emission period is prevented from being applied as a reverse-bias voltage to the light-emitting device of a diode type.

2. The display apparatus according to claim 1, characterized in that:

a gate of the driving transistor is connected to the input node, a drain of the driving transistor is connected to a power supply line, and a source of the driving transistor is connected to the output node;

an anode of the light-emitting device is connected to the output node with the switching transistor therebetween, and a cathode of the light-emitting device is connected to a ground line; and the auxiliary capacitor is connected between the output node and the ground line.

3. The display apparatus according to claim 1, characterized in that:

the pixels each include threshold-voltage correction means; and the threshold-voltage correction means operates in the non-light-emission period, and in a state where a potential exceeding the reverse-bias voltage is applied to the output node, the threshold-voltage correction means causes a voltage corresponding to a threshold voltage of the driving transistor to be held in the holding capacitor between the input node and the output node.

4. The display apparatus according to claim 1, characterized in that the pixels each include mobility correction means, the mobility correction means operates when the video signal is being written in the non-light-emission period, and in a state where electricity exceeding the reverse-bias voltage is applied to the output node, the mobility correction means negatively feeds back the driving current from the output node to the holding capacitor, thereby applying correction corresponding to a mobility of the driving transistor.

5. A driving method for a display apparatus including scanning lines in rows, signal lines in columns, and pixels arranged in a matrix in portions where the scanning lines and the signal lines intersect with each other, wherein the pixels each include at least a sampling transistor, a driving transistor having an input node and an output node, a switching transistor, a light-emitting device, a holding capacitor, and an auxiliary capacitor, wherein the sampling transistor is arranged between the signal line and the input node, wherein the switching transistor is arranged between the output node and the light-emitting device, wherein the holding capacitor is arranged between the input node and the output node, and wherein the auxiliary capacitor is connected to the output node, the driving method being characterized in that:

the sampling transistor is brought into conduction in accordance with a control signal supplied from the scanning line, and writes to the holding capacitor a video signal supplied from the signal line;

the driving transistor outputs a driving current to the output node in accordance with a signal potential of the video signal written to the holding capacitor; and in a predetermined light-emission period, the switching transistor is in an on-state and supplies the driving current to the light-emitting device to cause the light-emitting device to emit light at a brightness corresponding to the video signal, whereas in a non-light-emission period, the switching transistor is turned off to disconnect the light-emitting device from the output node, so that a potential generated at the output node due to an operation of the pixel performed in the non-light-emission period is prevented from being applied as a reverse-bias voltage to the light-emitting device of a diode type.

* * * * *